US006338552B1

(12) United States Patent
Sato et al.

(10) Patent No.: US 6,338,552 B1
(45) **Date of Patent: *Jan. 15, 2002**

(54) INK REFILLING METHOD AND APPARATUS, INK CONTAINER REFILLED THEREWITH AND INK JET APPARATUS COMPRISING INK REFILLING APPARATUS

(75) Inventors: Osamu Sato, Chigasaki; Toshiaki Hirosawa, Hiratsuka; Osamu Morita, Yokosuka; Shogo Kawamura, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/422,787

(22) Filed: Oct. 22, 1999

Related U.S. Application Data

(62) Division of application No. 08/747,079, filed on Nov. 8, 1996, now Pat. No. 6,024,442.

(30) Foreign Application Priority Data

Nov. 8, 1995 (JP) ..... 7-289892
Dec. 21, 1995 (JP) ..... 7-333160

(51) Int. Cl.[7] ..... B41J 2/175
(52) U.S. Cl. ..... 347/85
(58) Field of Search ..... 347/85, 86, 87

(56) References Cited

U.S. PATENT DOCUMENTS

| | | | | |
|---|---|---|---|---|
| 4,775,871 | A | 10/1988 | Abe et al. | |
| 4,967,207 | A | 10/1990 | Ruder | |
| 5,231,424 | A | 7/1993 | Kaneko et al. | |
| 5,280,299 | A | 1/1994 | Saikawa et al. | 347/87 |
| 5,280,300 | A | 1/1994 | Fong et al. | |
| 5,367,328 | A | 11/1994 | Erickson | 347/7 |
| 5,369,429 | A | 11/1994 | Erickson | 347/7 |
| 5,523,780 | A | 6/1996 | Hirosawa et al. | 347/86 |
| 5,561,448 | A | 10/1996 | Kaneko et al. | 347/29 |

FOREIGN PATENT DOCUMENTS

| | | |
|---|---|---|
| EP | 536980 | 10/1992 |
| EP | 611640 | 12/1993 |
| EP | 605183 | 7/1994 |
| EP | 640484 | 8/1994 |
| EP | 699532 | 8/1995 |
| JP | 59-68985 | 5/1984 |
| JP | 5-104735 | 4/1993 |
| JP | 7-1744 | 1/1995 |

*Primary Examiner*—Judy Nguyen
(74) *Attorney, Agent, or Firm*—Fitzpatrick, Cella, Harper & Scinto

(57) ABSTRACT

An ink container for containing ink to be supplied to a recording head includes a main body, an ink absorbing material accommodated in the main body to contain the ink, a connecting portion relative to a supply tube of the recording head for supplying ink to the recording head, and a refilling connection at a position different from that of the connecting portion for refilling the ink. An ink absorption member is provided at the refilling connection portion, the ink absorption member having a bundle of fibers and a capillary force higher than that of the ink absorbing material. In an ink jet recording apparatus usable with such an ink container, a refilling mechanism is provided to fill the ink into the refilling connection portion, the refilling mechanism including an ink chamber for containing ink and an ink discharge member of porous material for press-contactedly supplying ink to the ink absorption member. In preferred embodiments, the ink absorption member has a capillary force higher than that of the ink absorbing material, and the ink discharge member has a density smaller than that of the ink absorption member.

6 Claims, 13 Drawing Sheets

INK REFILLING METHOD AND APPARATUS, INK CONTAINER REFILLED THEREWITH AND INK JET APPARATUS COMPRISING INK REFILLING APPARATUS

This application is a division of application Ser. No. 08/747,079 filed Nov. 8, 1996, U.S. Pat. No. 6,024,442.

FIELD OF THE INVENTION AND RELATED ART

The present invention relates to an ink refilling unit used to refill ink into an ink container which stores the ink to be delivered to a recording head, an ink refilling method, and an ink jet apparatus comprising a refillable ink container and an ink refilling unit. In particular, it relates to an ink refilling system capable of effectively and reliably refilling even an ink container which is integrally and removably mountable on a recording head comprising a plurality of ink storing portions.

Recently, in the field of ink jet recording, an ink jet unit in the form of a cartridge, which integrally comprises a recording head and an ink container, has been used from the standpoint of size reduction, maintenance reduction, and the like. This ink jet unit is easily mountable on the scanning carriage of an apparatus, or is easily removable from the carriage. Further, when the ink in the ink container is completely depleted, the ink jet unit can be easily exchanged with a fresh ink jet unit.

On the other hand, there are high demands for colorization of record. As for the structure currently in use for meeting the above colorization demands using an ink jet unit as described above, there are a few structures for recording in color. For example, in one structure, record is made in color by a plurality of color ink jet units parallelly disposed on a carriage in the scanning direction. In another structure, record is made in color by a color ink jet unit and a black ink jet unit, which are also disposed on the carriage. In the case of the latter structure, the color ink jet unit integrally comprises an ink container for yellow ink, an ink container for magenta ink, an ink container for cyan ink, and a corresponding number of recording heads for ejecting these color inks.

However, the above structures had a problem in that a recording head still usable when the ink in an ink jet unit is completely depleted had been discarded. Therefore, in recent years, a few proposals have been made to solve this problem. According to one of these proposals, the recording head and the ink container are rendered separable.

Thus, it has been proposed to refill the ink container of such an ink jet unit with refill ink. More specifically speaking, according to the system of Graphic Utilities Co., Ltd., a metallic hypodermic needle attached to a bellows type ink supply container is inserted into a hole made in an ink depleted ink container, and the ink in the bellows type ink supply container is injected into the ink depleted ink container as pressure is gradually applied by manually collapsing the bellows type ink supply container. There is also a structure in which the bellows type ink supply container is replaced by a syringe, and the ink is pressure fed into the ink depleted ink container in a manner to give an injection.

The ink refilling methods described above has the following problems. First, since they are manual methods, there are many occasions in which excessive pressure is applied by the operator. As excessive pressure is applied, ink delivery speed exceeds the speed at which the delivered ink permeates into the absorbent member in the ink depleted ink container. As a result, ink drips from the needle tip without being injected into the container. Further, since it is impossible to know the exact amount of ink to be refilled, only way to know whether the ink container is completely filled or not is to wait until ink begin to overflow from the hole made in the ink depleted ink container. Secondly, since a needle must be handled to manually inject ink, the operator is sometimes injured. Thirdly, in order to refill ink without spilling it, it is required to maintain a proper amount of pressure, complicating the structure for satisfying such a requirement. Fourthly, since the pressure necessary to refill ink is manually generated, the time which the operator has to spend to refill ink becomes rather long. Fifthly, before the needle is inserted into the ink depleted ink container, the ink supply container of the bellows type or the hypodermic syringe type is rather sensitive to pressure, and therefore, slight impact causes ink to leak from the needle. Sixthly, when discarding an ink refilling kit, it has to be disassembled into individual components, which are separated according to material type, when it is discarded.

It is conceivable that the ink container opening, which is connected to the recording head, be used to refill ink into the removable ink container of the above described ink jet unit. But, as long as the aforementioned bellows type ink refilling kit or the like is used, the problems described in the foregoing remain. In particular, since the container opening, which is to be connected to the recording head, is substantially larger than the diameter of the needle of the ink refilling apparatus, the ink leakage related problem becomes a matter of more serious concern.

Japanese Laid-Open Patent Application No. 1,744/1995 discloses an ink filling apparatus of a different type. This apparatus comprises an ink cartridge (ink container) and a chamber for storing ink, and fills ink with the use of a capillary element. However, in this apparatus, the path through which ink is delivered when printing, and the section in which ink is filled, are different. Therefore, a sponge member and the capillary element must be pressed against each other to reliably fill ink. This creates two regions different in compression ratio, a region closer to the printing head, and a region closer to where ink is filled. When an attempt is made to refill ink into a completely ink depleted ink container of this type, air is taken into the region between these two differently compressed regions. As a result, it sometimes becomes impossible to continuously carry out printing. Further, when the sponge member and the capillary element are pressed against each other before the ink is completely depleted, ink leaks sometimes as the sponge member is squeezed.

Moreover, in the case of the structure disclosed in Japanese Laid-Open Patent Application No. 1,744/1995, the capillary element is rather long, increasing flow resistance. As a result, it takes a substantially longer time to fill. Also, as the ink within the refill ink chamber decreases, the internal pressure of the refill in chamber decreases. Consequently, the chamber reacts to suck in air. But, since there is no place where air can flow in, ink filling is interrupted. These are the additional problems.

Based on the knowledge and observation described above, the inventors of the present invention have already proposed an ink refilling method and an ink refilling apparatus, which do not have the aforementioned weaknesses. This ink refilling method is used in conjunction with an ink container of a specific type. That is, the ink container has an ink absorbent portion adjacent to the ink delivery port to which an ink recording head is connected, and contains a porous member which generates negative pressure within the container, wherein at least a part of the initially filled ink is consumed through the ink absorbent portion adjacent to the joint portion. This ink refilling method is characterized in that it comprises a step in which the ink meniscus at the ink absorbent portion of the ink container is destroyed, and a step in which the refill ink is filled into the ink depleted ink container by the negative pressure generated by the porous member through the ink consumption from the ink container. As for the essential point of the characteristic, the negative pressure generated through the consumption of the ink held by the porous member within the ink container is used to reliably refill the ink container with ink, without overfilling, that is, while preventing the ink from spilling out of the ink container. Preferably, ink should be refilled from the side from which the ink within the ink container is delivered to the recording head. Such an arrangement assures that ink is reliably refilled into the ink container to prevent the interruption of the ink delivery to the recording head.

Compared to the conventional method, the ink refilling method described in the foregoing can further improve on operational efficiency. More specifically, since the conventional ink refilling method employs only an unsophisticated filling device, the user has to hold both the ink container and the filling device at the same time, and therefore, it is low in operational efficiency. Such inefficiency can be eliminated with the use of the ink -refilling apparatus and the ink refilling method, which were described in the foregoing paragraph, so that ink is prevented from overflowing, and above all, ink can be refilled into the ink container in a manner to render the condition of the refilled container substantially the same as that of a freshly opened ink container.

More specifically, the above ink refilling system which is used in conjunction with an ink container for an ink recording head, in which an ink absorbent member is disposed in the ink delivery port connectible to an ink recording head, and in which an ink retaining member formed of porous material capable of generating internal negative pressure is disposed, comprises: a section for holding the ink recording head; a means for holding the refill ink for the ink container as well as delivering the refill ink to the ink absorbent member of the ink container; and a means disposed on the ink delivering means to destroy the meniscus of the ink absorbent member, wherein after the ink within the ink absorbent member is united with the ink retained in the ink delivering means, by the meniscus destroying means, the ink container is filled with the refill ink by the negative pressure induced through the ink consumption from the ink container.

The above described process (or means) for destroying the ink meniscus means any process (or means) capable of uniting the remaining ink in the ink container with the refill ink by destroying at least a part of the meniscus formed by the internal negative pressure of the ink container; for example, positive pressurization of the refill ink, or negative pressurization of the internal space of the ink container. A preferable means is the following one: the meniscus is destroyed by inserting a rod-like member, having a very small sectional area and being constituted of stands of fiber arranged to provide microscopic gaps, into the ink absorbent member, along with the refill ink which permeates the rod-like member due to capillarity.

Regarding the ink refilling system described above, the ink absorbent member of the ink container is positioned at a lower level in terms of the gravitational direction than the porous member of the ink container so that the refill ink is delivered upward from below. With this arrangement, the refill ink can be reliably filled into the ink container through the ink delivery port of the ink container. Further, according to the above described system, the ink absorbent member composed of strands of fiber unidirectionally bundled to improve ink delivery efficiency with which ink is delivered from the ink container to the recording head is also used on the refill mechanism side; therefore, the refill ink is more uniformly filled into the ink container. In particular, in the case of an ink container from which ink is delivered downward (preferably, straight downward) to the ink recording head when recording, the ink remaining in the ink container uniformly settles on the ink delivery port side; therefore, such an ink container can function more efficiently.

The above invention is also applicable to an ink container comprising a plurality of sub-containers for holding different inks. In the case of such an application, all the sub-containers are filled with the aforementioned porous material, and their ink delivery ports provided with their own absorbent ink delivery members are disposed on the same side of the ink container. Further, each sub-container is filled with refill ink by its own refill ink delivering means through the aforementioned absorbent ink delivery member. With this provision, each sub-container can be simply and reliably filled with the refill ink, to a predetermined ink level of its own, without color mix-up and without being overfilled.

SUMMARY OF THE INVENTION

The present invention was made to improve the above described ink refilling method and ink refilling apparatus, that is, to render them more cost effective, simpler to use, and more reliable.

In other words, the primary object of the present invention is to provide an ink refilling apparatus which requires only a simple step of mounting an ink container in the ink refilling apparatus to quickly fill the ink container with the refill ink, without the need for a dangerous member such as an ink injecting needle, and also is capable of preventing ink leakage, and preventing the user from being tied up for a long time to refill the ink container.

More specifically, the primary object of the present invention is to reliably unite the remaining ink in the ink container used with an ink recording head container, with the refill ink for the ink container, wherein the ink container has an ink absorbent ink delivery member in the ink delivery port which is connected to the ink recording head, and an ink retaining member formed of porous material capable of inducing negative pressure in the ink container, in the ink storage chamber. The second object is to quickly fill up the ink container by minimizing the flow resistance in the path through which the refill ink is filled into the ink container.

According to an aspect of the present invention, there is provided an ink refilling apparatus, comprising: an ink absorbing member at a connecting portion relative to an ink recording head; an ink container holding portion to which an ink container for the ink recording head provided with a porous ink retaining member capable of producing a negative pressure therein, is mountable; an ink discharging means for accommodating the ink to be refilled into the ink container and supplying the ink to the ink absorbing member of the ink container; wherein after the ink of the ink absorbing member and the ink retained by the ink discharging means are contacted to each other, the ink is refilled using a negative pressure produced by consumption of the ink from the ink container; the improvement residing in that ink absorbing member having substantially the same property as the ink absorbing member of the ink container is provided at an ink container connection side of the ink discharging means, the ink absorbing members are contacted to each other upon mounting of the ink container, by which a meniscus formed at a contact surface of the ink absorbing member, is broken.

The inventors of the present invention reconfirmed based on the above observation that the conventional ink refilling process for an ink jet recording apparatus was controlled by external factors such as the capacity of the ink delivery mechanism of the ink refilling system, and therefore, the process was liable to be hindered by excessive or insufficient external force, and that currently, when an ink container which contained the ink absorbent member composed of porous material (being at least partially compressed, or entirely compressed to half or quarter the precompression size) was filled with ink for the first time, ink was forcefully filled into the ink absorbent member by reducing the internal pressure of the ink container. Also during the above observation, they discovered a phenomenon that as ink was consumed from the ink absorbent member filled with ink, the absorbent member developed a substantial amount of negative static pressure, that is, the sum of minute negative static pressure induced in each microscopic pores of the ink absorbent member. Thus, they realized that using this phenomenon for refilling the ink container is the most rational way to refill the ink container, and made the present invention which made it possible to reliably refill the ink container regardless of the amount of the ink remaining in the ink container, without causing an ink overflow.

Thus, according to the present invention, a method for refilling an ink container containing a porous member capable of generating negative pressure within the ink container, after at least a portion of the initially filled ink is consumed, is characterized in that it comprises a step in which the ink meniscus formed in the ink container, on, or adjacent to, the portion to be connected to a recording-head, is destroyed, and a step in which the refill ink is filled into the ink container due to the negative pressure which the porous member develops as the ink is consumed therefrom, while maintaining contact between the refill ink and the joint portion.

Also, a method for refilling an ink container in which an ink absorbent member is disposed on, or adjacent to, the portion to be connected to a recording head, and a porous member capable of generating negative pressure within the ink container is disposed in the ink storing portion, after at least a portion of the initially filled ink is consumed, is characterized in that it comprises a step in which the ink meniscus formed in the ink container, on, or adjacent to, the portion to be connected to a recording head, is destroyed, and a step in which the refill ink is filled into the ink container due to the negative pressure which the porous member develops as the ink is consumed therefrom, while maintaining contact between the refill ink and the joint portion.

The gist of the present invention is to use the negative pressure generated as the ink retained in the porous member of the ink container is consumed, to reliably refill the ink container, without overfilling or causing an ink overflow. Further, it is most desirable that the refill ink is filled into the ink container through the side through which ink is delivered to the recording head portion. This is because such an arrangement can prevents interruption of ink flow, and therefore, can most reliably refill the ink container.

The above described process (or means) for destroying the ink meniscus means any process (or means) capable of uniting the remaining ink in the ink container with the refill ink by destroying at least a part of the meniscus formed by the internal negative pressure of the ink container; for example, positive pressurization of the refill ink, or negative pressurization of the internal space of the ink container. A preferable means is the following one: the meniscus is destroyed by inserting a rod-like member, having a very small sectional area and being constituted of stands of fiber arranged to provide microscopic gaps, into the portion to be connected to the recording head, the adjacencies of the portion, or the ink absorbent member, along with the refill ink which upwardly permeates the rod-like member due to capillarity.

Regarding the ink refilling system described above, the ink absorbent member of the ink container is positioned at a lower level in terms of the gravitational direction than the porous member of the ink container so that the refill ink is delivered upward from below.

Further, according to the present invention, the ink absorbent member composed of strands of fiber unidirectionally bundled to improve ink delivery efficiency with which ink is delivered from the ink container to the recording head is also used on the refill mechanism side. In particular, in the case of an ink container from which ink is delivered downward (preferably, straight downward) to the ink recording head when recording, the remaining ink in the ink container evenly settles on the ink delivery port side; therefore, such an ink container can function more efficiently.

In the case of the present invention structured as described above, when the refill ink is filled into the ink container, an ink reception member which is formed of porous material and is compressed against an ink absorbent member which is formed of porous material and is disposed in the ink container to retain ink, and a first ink delivery member which is composed of porous material and is disposed in a refilling mechanism for delivering the refill ink into the ink container, are pressed against each other, whereby the refill ink stored in the refilling mechanism is delivered into the ink container.

Since the refill ink is delivered into the ink container by the negative pressure generated by the porous material, it is unnecessary to reduce the internal pressure of the ink container by a pump or the like, and also, external ink leakage does not occur. Further, the refilling of the ink container is triggered by destroying the meniscuses of the ink absorbent ink reception member and the ink absorbent delivery member by placing the two absorbent members directly in contact with each other; therefore, it is possible to provided an inexpensive but highly reliable ink refilling apparatus.

Further, the ink absorbent member of an ink delivery means, which is disposed on the side which faces the ink container, is rendered substantially equal in size to the ink absorbent member of the ink container, or is rendered smaller in density than the ink absorbent member of the ink container; therefore, the flow resistance of the ink path is minimized. As a result, it takes only a short time to completely refill the ink container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
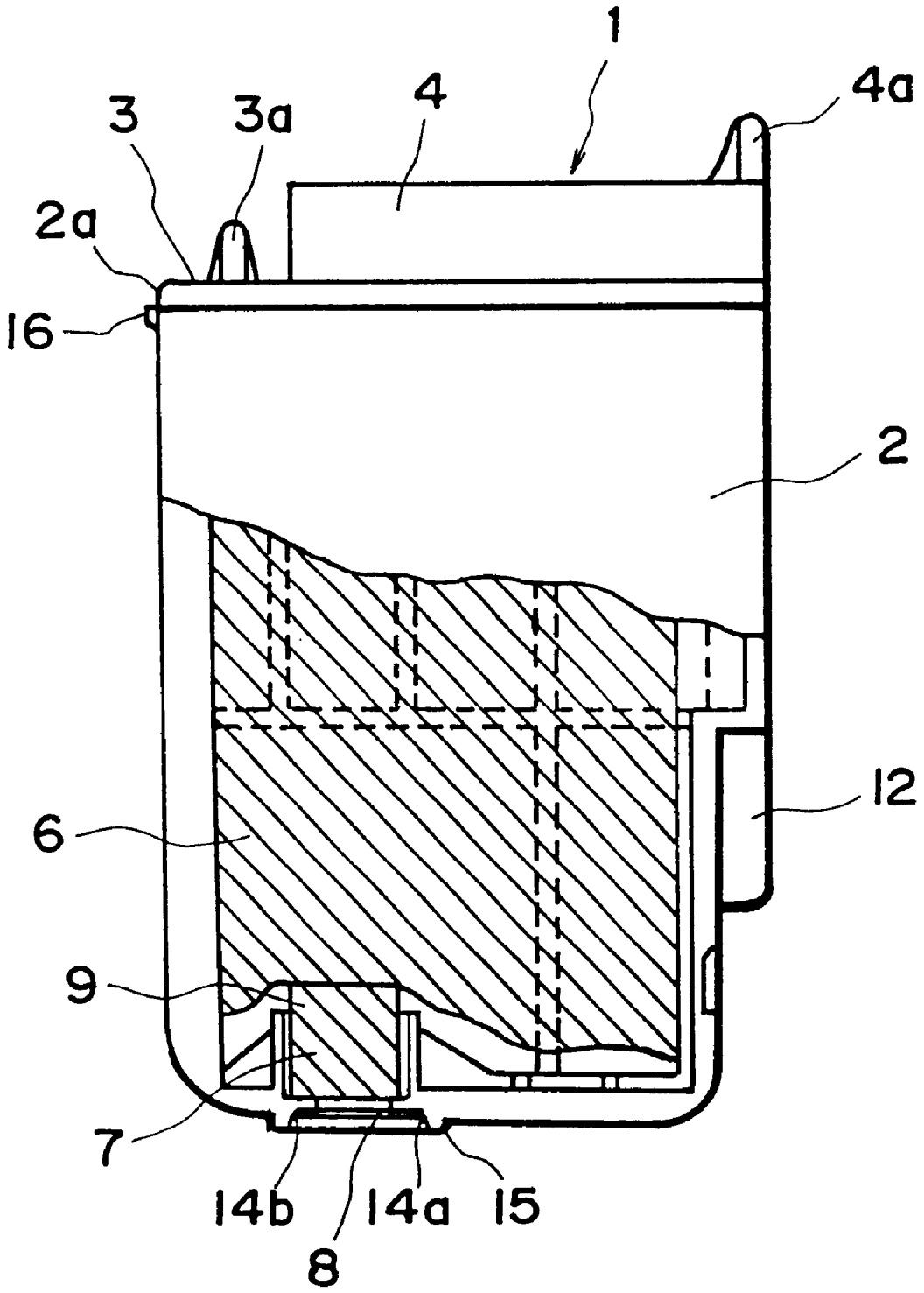
FIG. 1 is a schematic side view of a partially cutaway ink container which stores black ink.

Hereinafter, the present invention will be described with reference to the drawings. First, the general feature of the ink container in accordance with the present invention will be described. FIG. 1 is a partially cutaway side view of an ink container 1 storing black ink, and depicts the general structure thereof.

An ink container 1 comprises an ink holding shell 2, a lid 3, and a top member 4. The lid 3 is provided with an air ventilation opening (unillustrated), and covers the opening of the shell 2. The top member 4 is provided with a space which plays a role of a buffer chamber for preventing ink from leaking out through the air ventilation opening of the lid 3, an air ventilation opening of its own, and a knob 4*a*, and is fixed to the top surface of the lid 3. The air ventilation opening of the top member is disposed away from the air ventilation opening of the lid 3. The knob 4*a* is used to mount the ink container 1 on an ink jet unit 101 or to remove it.

The bottom wall of the ink container is provided with an ink delivery port 8, a rib 15, and slanted portions 14*a* and 14*b*. The rib 15 surrounds the ink delivery port 8, and they are connected by the slanted portions 14*a* and 14*b*. The ink reception tube of the ink jet unit 101 on which the ink container is mounted is inserted into the ink delivery port 8.

According to the present invention, the ink delivery portion of the ink container filled with an elastic member is provided with an ink delivery member 7 formed of a bundle of fiber strands (hereinafter, ink delivery member).

The provision of a bundle of fiber strands in the ink delivery member 7 is highly effective to stabilize the pressure which is desirable to be present after the ink reception tube of the recording head, which is equipped with a filter, is pressed onto the ink delivery member 7.

The configuration of the ink delivery member 7 is as shown in FIG. 1, for example. That is, the ink delivery member 7 is disposed between the ink absorbent member 6 and the ink delivery port 8. It is desirable that the ink delivery member 7 is composed of ink absorbent material, and has a bundle of fiber strands at least on the side which faces the ink container. However, it may be composed of only ink absorbent material such sponge. In order to support the ink delivery member 7 in the ink container, a support member 9 is inwardly erected from the peripheral edge of the ink delivery port 8. A part of the internal surface of the support member 9 is provided with a slit for connecting the internal space of the ink container to the outside.

An ink delivery member is such a member that guides ink only in one direction. In this embodiment, it guides ink from the ink absorbent member toward the ink delivery port 8.

In this embodiment, the porous member disposed in the ink storing portion of the ink container is a piece of ink absorbent material. It is compressed into the ink container. As for the ink absorbent material permeable by ink, sponge or the like can be listed, for example.

The ink delivery member 7 is fixed in its holder portion in the ink container, and is in contact with the ink absorbent member 6 compressively disposed in the ink container, maintaining a predetermined contact pressure and thereby, keeping the contact portion of the ink absorbent member deformed. This deformation of the ink absorbent member increases capillary force, and therefore, ink is concentrated to the adjacencies of the ink delivery member 7.

Therefore, even after the recording head and the ink container is separated, ink always collects in the ink delivery member 7, and forms meniscus on the surface of the ink delivery member 7, on the side facing the ink delivery port 8. As a result, air is not sucked into the ink container.

Also, after the recording head and the ink container is connected, and an ink path is established, the continuous presence of ink in the adjacencies of the ink delivery member 7 helps ink to flow into the ink delivery member 7, and prevents the ink flow from being interrupted. As a result, the amount of the ink which otherwise will be left unused in the ink container is reduced, improving thereby ink usage efficiency.

Normally, the ink delivery member 7 is composed of strands of fiber. Proper material for the ink delivery member 7, which is desired to be chemically stable, and also to be good in wettability, is polyester, nylon, polypropylene, polyethylene, cellulose, polyurethane, and the like.

As for the criteria for good wettability, generally, having a small contact angle relative to ink may be listed. Even material such as Teflon having a large contact angle can be used as long as it is processed to give it hydrophilic properties. However, in consideration of the fact that the process to give hydrophilic properties increases the number of manufacturing steps, and also product cost, material with a smaller contact angle relative to ink is preferable.

In addition to the materials listed above, metallic fiber, glass fiber, carbon fiber, or the like, may be employed. Also, the listed materials may be employed in combination.

Since the ink delivery member constitutes a part of the ink flow path, it must be given unidirectionality in ink delivery. Further, since it is pressed against the ink reception portion of the recording head, it must have physical strength to retain its original configuration. In order to satisfy the above requirements, fiber strands are desired to be bundled.

The condition which determines the upper limit for the thickness of the fiber of the ink delivery member is the desired state of contact between the aforementioned filter disposed in the ink reception area, and the ink delivery member. In view of this condition, the thickness of the fiber is desired to be no more than 0.05 mm. Further, the bottom limit for the fiber thickness is desired to be no less than 0.01 mm, in view of the fact that a number of fiber strands are to be bundled to form an ink delivery member, and in order to reduce cost and also to simplify the process for bundling the fiber strands.

As to means for keeping a number of fiber strands bundled together, there is a method, among others, in which the peripheral portion of a rod-like member (ink delivery member 7) constituted of a temporarily bundled fiber strands, is hardened with resin binder, that is, the peripheral portion of the ink delivery member is rendered hard.

Figure 2A:
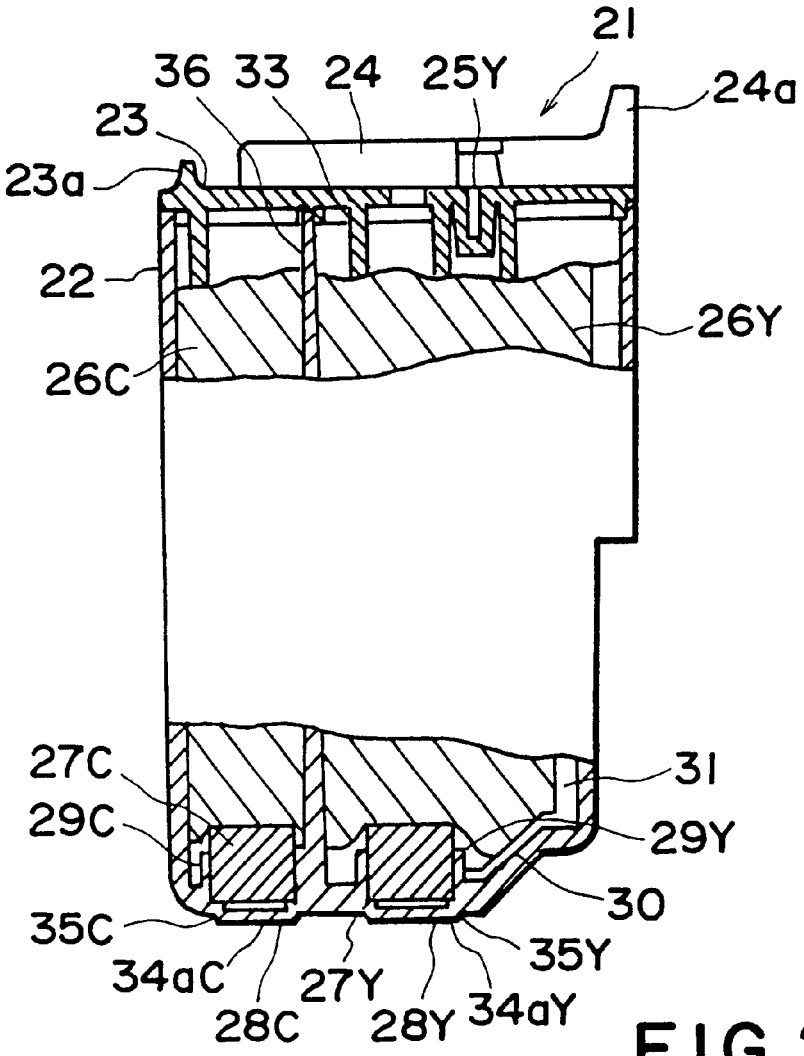
FIG. 2(*a*) is a schematic side view of a partially cutaway ink container which stores color inks (yellow, cyan, and magenta ink), and FIG. 2(*b*) is a bottom view thereof.
Figure 2B:
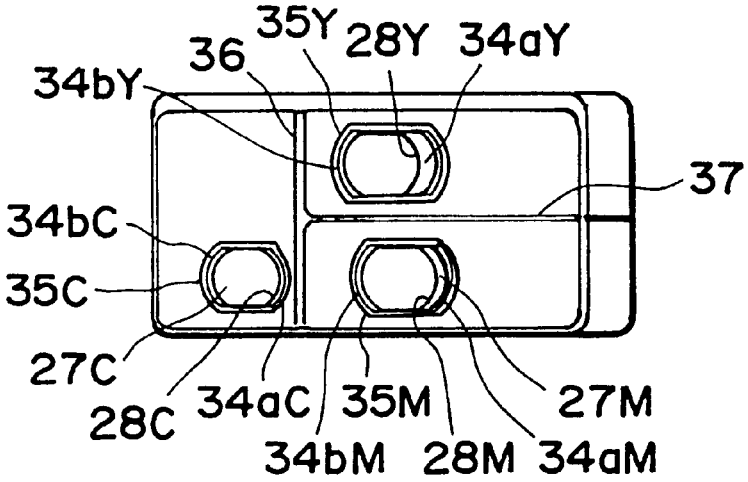

Referring to FIGS. 2(*a*) and 2(*b*), the color ink container 21 containing color inks (in this embodiment, yellow (Y), cyan (C), and magenta (M) inks) is formed as a single piece ink container integrally comprising sub-containers for these color inks.

Referring to FIG. 2(*b*), the space within the ink storage shell 22 of the color ink container 21 is partitioned with partition members 36 and 37 which form substantially a letter T. The amount of the color ink stored in each sub-space created by the partition members 36 and 37 is the same as those in the other sub-spaces. Dividing the ink container space in this manner makes it possible to dispose the ink delivery port of each sub-container adjacent to the point where three sub-container meet.

Partitioning the ink container space in the manner described above, and disposing the ink delivery ports of the sub-containers adjacent to the point where the sub-containers created by the partition members forming substantially the letter T meet, make it possible to extremely reduce the space necessary to join the ink container with the recording head, and also to reduce the projection area of the ink container. In addition, the amount of the ink storable in the ink container can be rendered rather large for the smallness of the projection area of the ink container, and the smallness of the joining space.

The interior of the ink container 2 is structured in the same manner as the ink container 1 illustrated in FIG. 1. That is, ink absorbent members 26Y, 26M and 26C are disposed in the corresponding sub-containers, and ink delivery members 27Y, 27M and 27C are disposed between the ink absorbent members 26Y, 26M and 26C and the corresponding ink delivery ports 28Y, 28M and 28C. A part of the internal surface of each of support member 29Y, 29M and 29C which support the corresponding ink delivery members 27Y, 27M and 27C within the corresponding sub-ink containers, is provided with a slit which connects the internal space of the sub-ink container to the outside.

A lid 23 is provided with a rib 33 which creates a predetermined amount of space between the ink absorbent members 26Y, 26M and 26C and the lid 23. The external surface of the lid 23 is provided with a ridge 23*a*, which is engaged with the overhang portion of the ink jet unit to apply, from above, downward pressure to the ink container 21. This downward pressure keeps the mounted ink container 21 stable.

Figure 3:
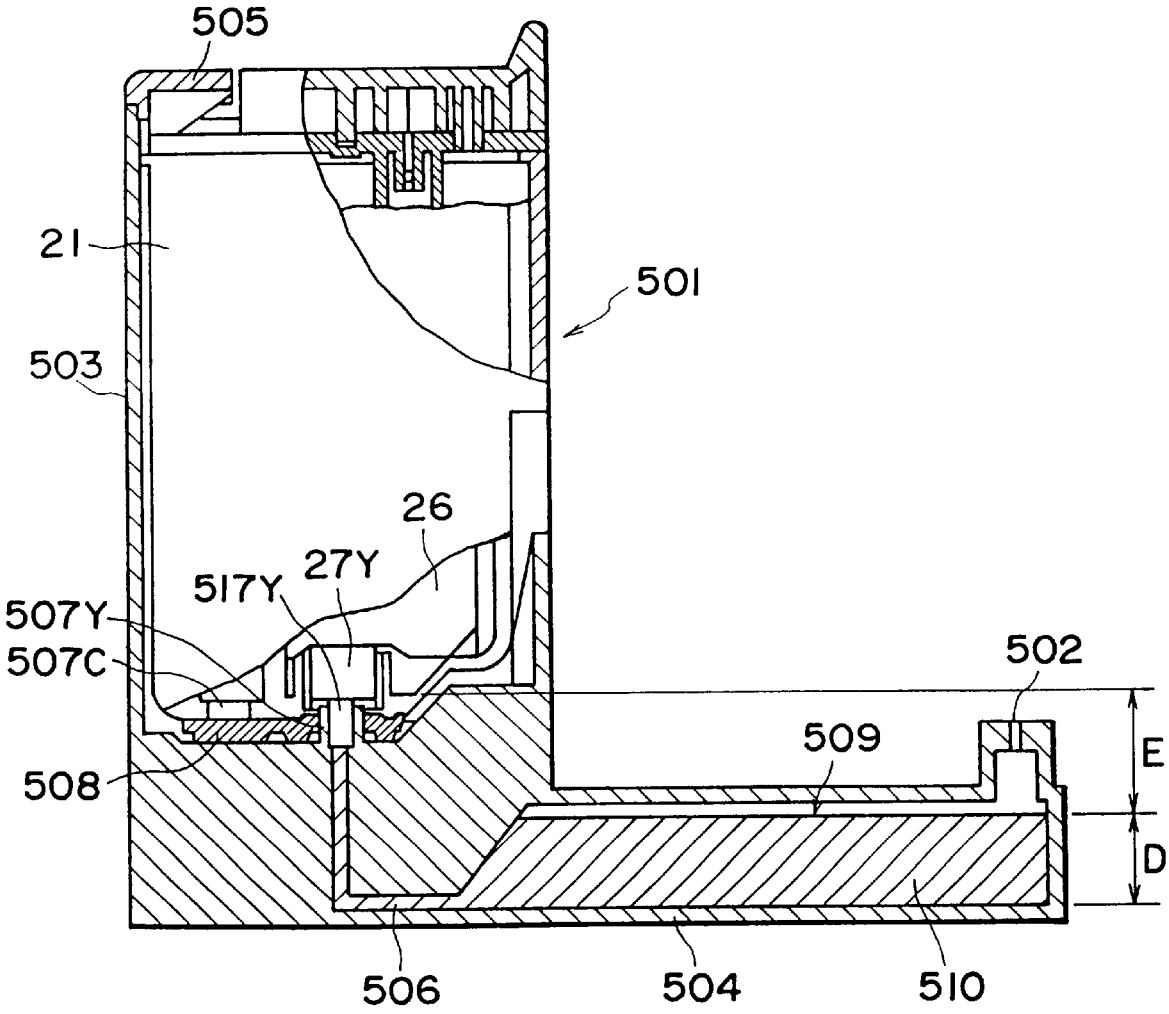
FIG. 3 is a schematic sectional drawing depicting an example of ink filling method used in conjunction with the ink refilling apparatus in accordance with the present invention. In the drawing, an ink container is connected to the ink refilling apparatus.

FIG. 3 shows an example of the ink container refilling apparatus in accordance with the present invention. The refilling apparatus in the drawing is in connection with the ink container 21. An ink container holder (hereinafter, holder) 501 comprises a shell 503, an overhang portion 505, a front plate 513, an ink delivery member 517 (517Y in this drawing), an ink delivery port 507 (507Y in this drawing), an elastic member 508. The ink delivery member 517Y is substantially the same in length as the ink delivery member 27Y of the ink container 1, and is pressed in the ink delivery port 507Y, with its contact tip sticking out of the ink delivery port 507Y. The holder also comprises a number of positioning members and the like which allow the ink container 21 to be removably mounted in the holder.

The bottom portion of the main structure of the ink container refilling apparatus 500 comprises an ink chamber 504, an ink delivery tube 506, and an air entrance 502. The ink chamber 504 is to contain ink 510. In this embodiment, ink is described as yellow ink, and the description given below is also true with cyan (C) ink and magenta (M) ink.

First, filling of ink into the ink refilling apparatus 500 will be described. First, ink is filled into the ink chamber 504 before the ink delivery member 517Y is pressed into the ink delivery port 507Y. Therefore, ink can be easily filled through the ink delivery port 507Y. After the ink chamber 504 is filled with ink, the ink delivery member 517 is pressed in. Since pressing alone is liable to allow the ink delivery member 517Y to come off during transportation, it is desirable that the ink delivery member 517 be glued. Simply pressing the ink delivery member 517Y into the ink delivery port 507 does not cause the ink to reach the ink delivery member 517Y; in other words, it does not cause the refilling apparatus to function. Therefore, ink is caused to come in contact with the ink delivery member 517Y by, for example, lifting the right-hand side (air entrance 502 side) of the refilling apparatus, in FIG. 3. The ink delivery member 517Y is constituted of bundled strands of fiber or the like as those of the ink delivery member 27Y, so that ink is sucked upward into the ink delivery member 27Y, and retained there, by capillary force. Therefore, even after the tilted refilling apparatus is leveled again as it was, ink remains in the ink delivery member 517Y as well as the path thereto from the ink chamber 504. Then, the air entrance 502 is covered with a rubber cap (unillustrated) to prevent ink from leaking.

Figure 4:
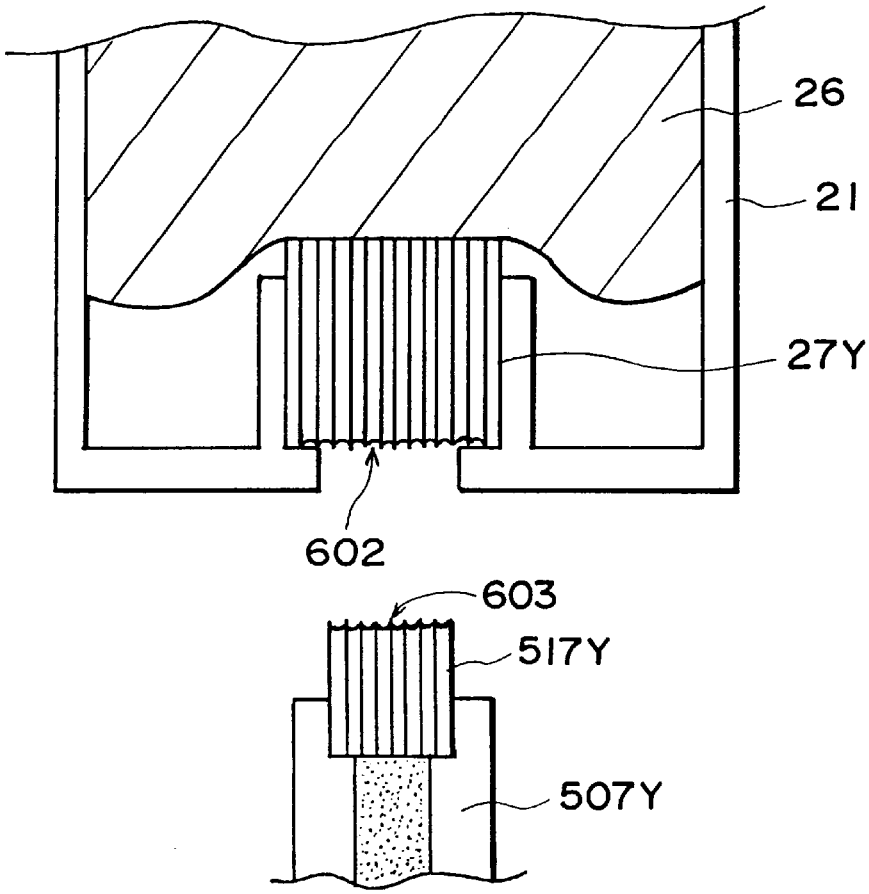
FIG. 4 is a sectional drawing, illustrating the ink reception member 27Y of the ink container, and the ink delivery member 517Y of the ink refilling apparatus, immediately before they are connected.

As a used ink container 21 is mounted after removing the aforementioned cap, the used ink container 21 tries to suck up the ink 510 due to the presence of static negative pressure in the ink absorbent member 26 of the ink container 21, but if air remains between the ink meniscus (unillustrated) on the side of the ink delivery member 517Y of the refilling apparatus 500, and the ink meniscus (unillustrated) on the side of the ink delivery member 27Y of the ink container 21, refilling of the used ink container 21 does not occur; therefore, the user has be very sure that these ink delivery members are directly in contact with each other. Referring to FIG. 4, before two ink delivery members 27Y and 517Y are placed in contact with each other, ink meniscuses 602 and 603 are present on the surfaces (exposed surfaces) of the members.

Figure 13:
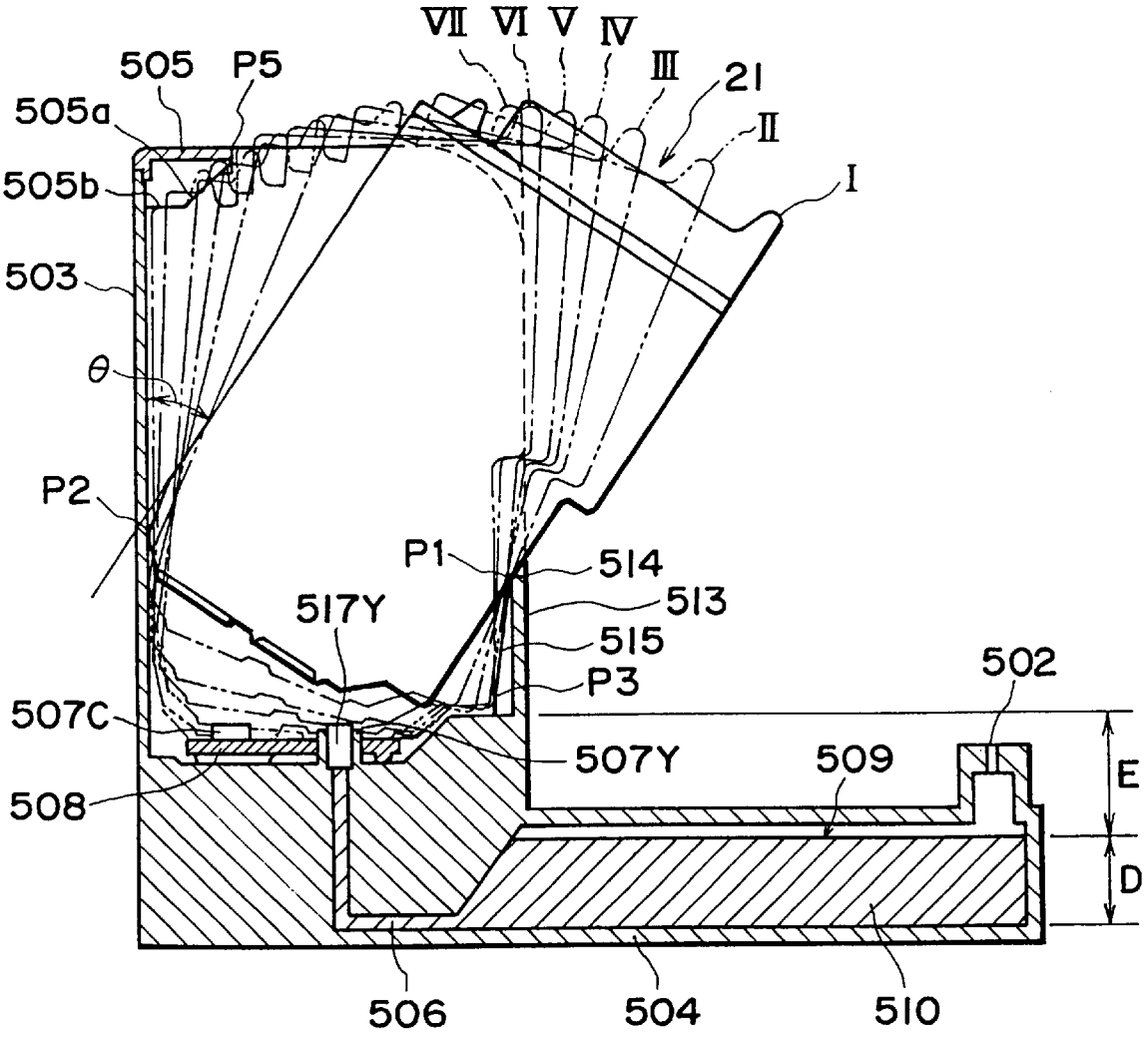
FIG. 13 shows mounting of ink container to an ink refilling apparatus.

FIG. 13 illustrate a typical ink container installation sequence, in particular, for the color ink container 21.

First, referring to FIG. 13, the ink container 21 is picked up by the tab portion, and is inserted into the ink container accommodating portion, as illustrated by a state I. At this time, the top portion 514 of the front plate 513 is placed in contact with a point (P1) of a lateral wall of the ink container, being used as the guide, and one (P2) of the bottom corners of the ink container is placed in contact with a lateral wall of the casing 503. Then, the bottom corner P2 is gradually slid downward, whereby the ink container is rotated about P1, settling in a state illustrated in FIG. 13. As the bottom corner P2 is further slid downward, a state III is realized.

It is extremely important, at this time, that the user can feel with his hand that the ink container is smoothly sliding. In this embodiment, this is accomplished by giving an R-shape (approximately R3) to the ink container corner (P2) that is abutted on the lateral wall surface (rear side) of the casing 503. This provision of the R-shaped corner allows the ink container to slide smoothly, being virtually rotated about the contact point P1 established between the ink container and the top portion 514 of the front plate 513; therefore, the ink container is smoothly slid downward as the contact points P1 and P2 are allowed to shift smoothly in coordination, giving the user a preferable feel of contact.

When the ink container is in the state III, the other bottom corner portion P3 of the ink container, which has reached the internal bottom portion of the casing 503, is in contact with the casing 503, and as the ink container is further inserted, the slanted portion, which is formed so as to continue from the R-shaped portion given to the other bottom corner P3, comes in contact with the internal wall of the casing 503. In the FIG. 13 that illustrates the stage III, the ink tapping pipe 507Y is ready to enter the ink delivery port of the ink container (it should be noted that the ink tapping pipe 507M is also ready to enter the ink delivery port of the magenta ink container disposed next to the yellow ink container). However, the ink tapping pipe 507Y comprises therein the aforementioned ink delivering member 517Y constituted of the fiber bundle, the fiber bundle is sometimes damaged through the friction between the fiber bundle and ink delivery port; therefore, it is preferable that the dimensions of the casing and ink container are adjusted so that the ink tapping pipe does not come in contact with the ink delivery port of the ink container, in the state III, and a state IV, which will be described.

At this time, the tip of the member 517Y of the ink tapping pipe 507 contacts the ink delivery port, but, since the port is given the slanted surface as illustrated in FIG. 2(*b*), the insertion continues without a hitch.

Further, since the ink container goes through the rotational movement during its installation, each ink tapping pipe comes in contact with the corresponding ink delivery port at a different time, depending on where each ink delivery port is located; therefore, the inclination of its slanted surface is rendered gentler in the order of its contact with the corresponding ink tapping pipe. In other words, the yellow and magenta ink containers are provided with a slanted surface having substantially the same inclination, and the slanted surface of the ink delivery port of the cyan ink container is the most inclined.

Since the ink delivery port portion is provided with the slanted surface, and its inclination is rendered gentler on the upstream side relative to the direction in which the ink container is inserted into the casing, and is rendered steeper on the opposite side, the ink container can be rotated for the installation, being disposed right next to the port portion, and yet, without causing the ink delivery member 517, which is to be connected to the ink container while the ink container is rotatively inserted in the casing, to interfere with the port portion, and also, the ink delivery port portion can be designed without being expanded more than an ordinary one.

Now then, as the insertion is continued, the bottom portion P3 of the ink container, at which the ink container also comes in contact with the casing, slides and shifts toward the font side, causing the ink container to be inclined against the slanted portion of a rib 515, which is provided on the casing 503, on the internal surface of the top portion 514.

At this time, the top corner P5 of the ink container, that is, the corner on the downstream side relative to the vertical direction in which the ink container is inserted, comes in contact with the top end of the slanted portion provided on the shoe portion 505, and begins to generate the insertion resistive feel (state IV illustrated in FIG. 13).

Figure 14A:
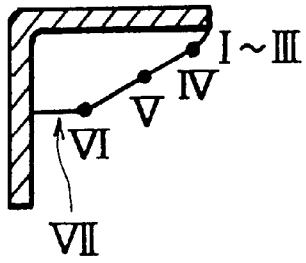
FIG. 14 shows a relationship between positions P5 of the ink container and resistance against insertion thereof during the mounting thereof, wherein (a) shows positions P5 in stages I–VII, and (b) is a graph showing the relationship.
Figure 14B:
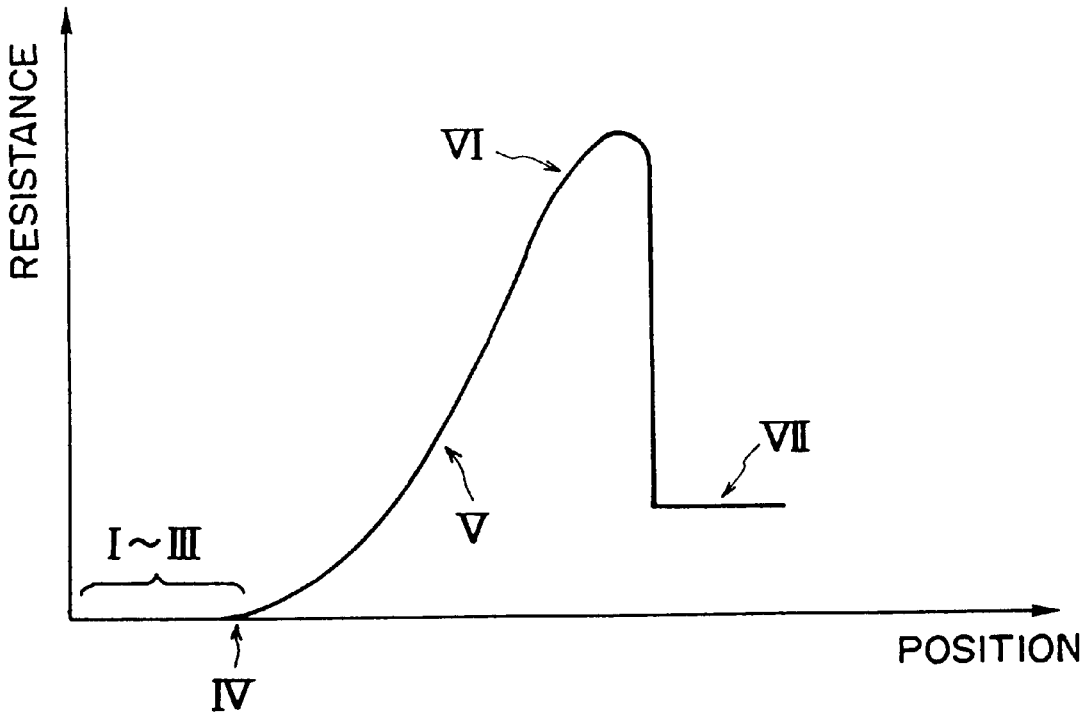

Referring to FIG. 14, it shows the relation displayed between the location of P5 and the insertion resistive force during the ink container inserting operation. In the states I–III, there is no insertion resistive force since there is no contact between P5 and the casing, as shown in the drawing, and then, in the state IV and thereafter, the resistance gradually increases.

FIG. 13 illustrates a state V in which the insertion has gone further, and in this state, the corner P5 is at a location where the insertion resisting force is much larger than in the state IV, as FIG. 14(*b*) shows. At this time, the ink container is under a downward pressure effected by the configuration of the slanted portion 505*a*.

In a state IV illustrated in FIG. 13, the ink container corner P5 is near the end of its travel. At this time, the insertion resisting force is the highest as is evident from FIG. 14(*b*).

Then, as the ink container is further inserted, a state VII illustrated in FIG. 13 is realized, completing the insertion; in other words, the moment the ink container corner P5 finishes traveling on the slanted portion 505*a*, it snappily engages with the pressing means 505*b*. Since the contact surface of the pressing means 505*b* is horizontal, the feel of resistance having been felt up to this point suddenly disappears at this moment, and this sudden disappearance of the resistance is felt by the user, with his hand, as a feel of the completion of a successful installation.

At this time, projections (not shown) provided on the ink container are snappily accelerated toward the internal wall of the casing as they are released, and when they collide with the wall, they generate a "clicking" sound, or a sure feel of clicking, which adds to the feel of the successful completion of the installation. Also at this time, the ink container is pressed downward by the horizontal portion of the pressing means, being surely locked in place.

As described above, when the ink container 21 is mounted in the image forming apparatus, the ink delivery member 27Y of the ink container 21 employed in this embodiment of the present invention rubs against the ink reception tube 101Y of the image forming apparatus. In the same manner, when the used ink container 21 is mounted in the ink refilling apparatus in this embodiment, and therefore, the ink delivery member 27Y of the used ink container 21 is connected to the ink delivery member 517Y of the ink refilling apparatus, they also rub against each other. As a result, the ink meniscuses 602 and 603 illustrated by the sections of the essential portions of two members in FIG. 4 are reliably placed in contact with each other, causing the remaining ink (unillustrated) of the ink container 21 to be united with the ink 510 in the ink chamber 504, and therefore, causing ink refilling to start.

In this embodiment, the material for the ink delivery member 517Y of the refilling apparatus and the material for the ink delivery member 27Y of the ink container are selected so that both materials be substantially similar in function or properties. More specifically, "being similar in function or properties" means being similar in wettability by ink, physical strength, or the like. Therefore, both members are formed of the same material, and are rendered the same in length.

Further, in this embodiment, the ink delivery member 517Y of the refilling apparatus is rendered smaller in external diameter than the ink delivery member 27Y of the ink container, in order to prevent the ink delivery member 517Y from coming in contact with the internal wall of the ink delivery port of the ink container. This arrangement can prevent the contamination caused by ink adhesion. The density of the ink delivery member 27Y of the ink container is set to render the capillary force of the ink delivery member 27Y larger (for example, −150 mmAq) than that of the ink absorbent member of the ink container (generally, −30 mmAq−−100 mmAq) so that ink flow interruption, ink leakage, and the like, can be prevented. On the other hand, the density of the ink delivery member 517Y has only to be high enough to create sufficient capillary force (−50 mmAq or so) to prevent the ink flow in the refilling apparatus from being interrupted. Therefore, the density of the ink delivery member 517Y can be reduced, allowing the external diameter thereof to be reduced without increasing the flow resistance. As a result, refilling time can be reduced. Further, in case both ink delivery members are the same in density and material, the following occurs. That is, when the strands of fiber in both members perfectly meet the counterparts, the cross-section of the ink path provided by the bundled strands of fiber becomes largest, but when they completely miss the counterparts, the cross-section of the ink path becomes minimum, that is, almost zero. In other words, rendering them different in density is not rendering the cross-section of the ink path smaller, and can reduce the refilling time. This statement applies to the case in which both ink delivery members are the same in structure as described above. However, when both ink delivery members are different in structure, for example, when one is in the form of felt, and the other is in the form of parallelly bundled strands of fiber, such a combination is more effective.

As the aforementioned steps are carried out, the ink 510 within the ink chamber 504 is flawlessly sucked up into the ink container 21 by the negative static pressure generated by the ink retaining member 26. The ink chamber 504 is designed so that the distance E between the ink surface 509 and the bottom surface of the ink delivery member 27Y becomes, for example, 20 mm when the ink surface 509 drops to the minimum level required for flawless ink delivery to the ink container. This is due to the characteristic of the static negative pressure of the ink retaining member 26. As ink refilling is repeated, the ink within the ink chamber 504 is reduced, which in turn increases the distance E. In order to prevent the negative static pressure from excessively changing, distance D, which is the depth of the ink in the ink chamber 504 is desired to be approximately 10 mm. Therefore, in order to increase the ink capacity of the ink chamber 504, the ink chamber 504 must be designed to be flat as shown in FIG. 3.

Figure 5:
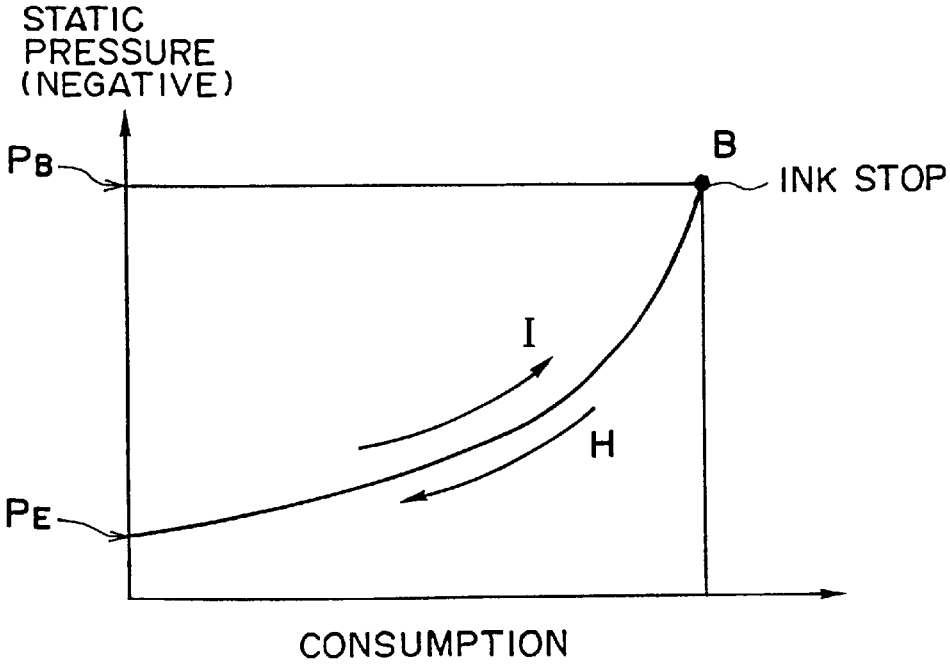
FIG. 5 is a graph showing the relationship between the amount of ink consumption and negative static pressure.

FIG. 5 shows the relationship between the amount of ink consumption from the ink container and the negative static pressure P. In the case of an ink container employing an absorbent member, the negative static pressure increases as the ink in the ink container is consumed (line I). Then, as the negative pressure reaches a predetermined value ($P_B$), the ink consumption from the ink container is forced to end (ink flow stops at a point B).

Normally, the ink container is mounted in the ink refilling apparatus after the negative static pressure generated by the ink holding member 26Y holding yellow ink (Y) and the ink delivery member 27Y reaches the point B in FIG. 5. As the ink in the ink refilling apparatus is united with the remaining ink in the ink container through the ink delivery member 27Y, the ink stored in the ink chamber 504 is sucked up into the ink container by the negative static pressure $P_B$ (FIG. 5) generated by the ink holding member 26Y and the ink delivery member 27Y. While the ink is sucked into the ink container, the negative static pressure at the tip of the ink container changes in the direction indicated by a line H, which is opposite to the negative pressure change (line I) that occurs while ink is consumed from the ink container.

In the case of the apparatus described above, even if thee color inks are consumed at different rates, each ink can be refilled to a level at which the aforementioned ink head pressure becomes equivalent to a negative static pressure $P_E$, as long as three color ink refilling apparatuses are initially structured to be equal in the aforementioned ink head pressure, that is, as long as the initial setup satisfies: PY=PM=PC.

Figure 6:
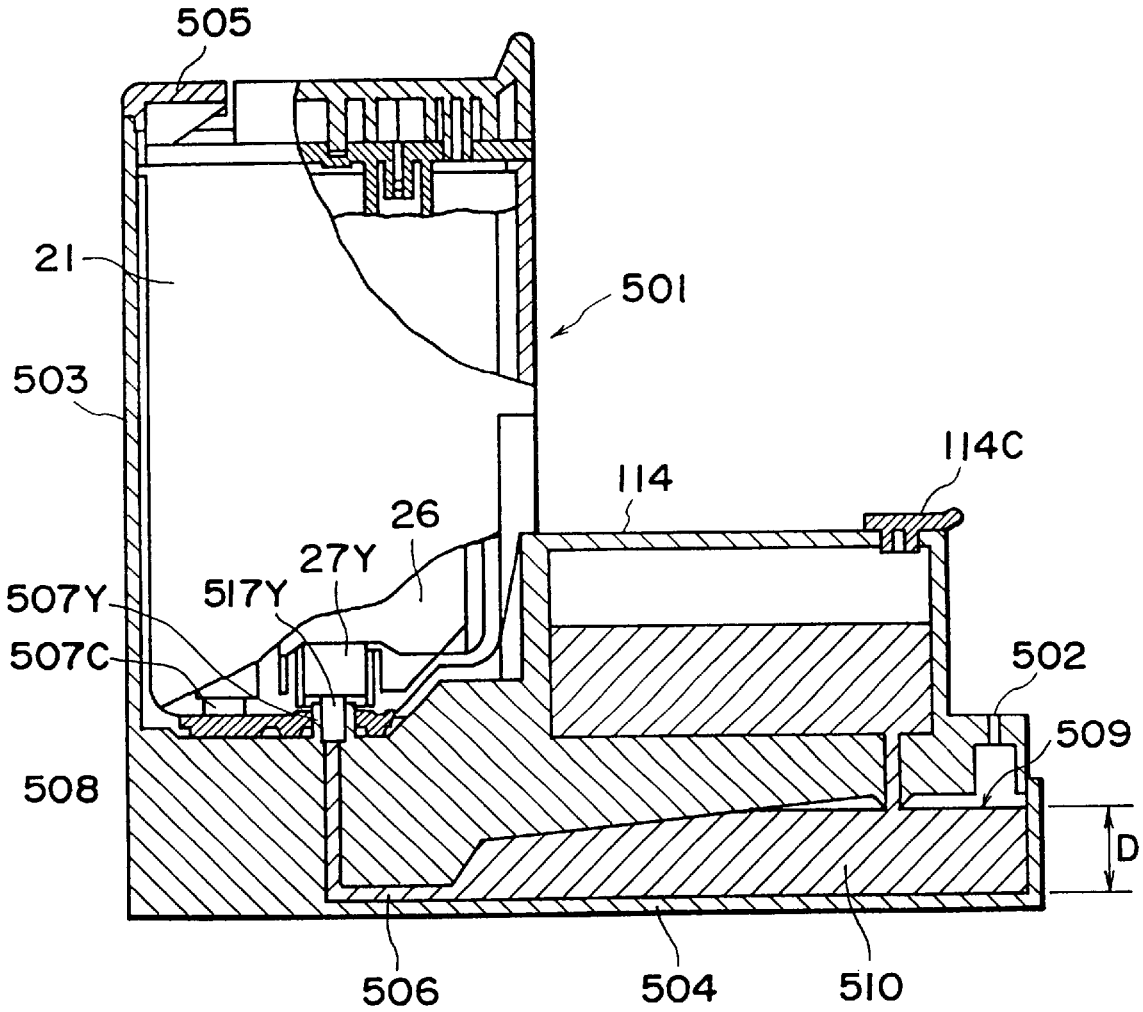
FIG. 6 is a schematic sectional drawing depicting an ink refilling method used in conjunction with the chicken feeder type ink refilling apparatus in another embodiment of the present invention.

FIG. 6 illustrates another embodiment of the ink refilling apparatus in accordance with the present invention. This apparatus is similar to the apparatus illustrated in FIG. 3 except that this apparatus employs a chicken feeder system to keep the ink level on the ink refilling apparatus side substantially constant. Since this ink refilling apparatus and the ink refilling method used in conjunction with this apparatus are the same as those of the ink refilling apparatus illustrated in FIG. 3, matters common to both will be omitted and description will be concentrated on the difference.

The ink chamber 504 in FIG. 6 is provided with an auxiliary ink chamber of a chicken feeder type. The tip of the ink delivery tube of the auxiliary ink chamber is disposed to be in contact with the ink surface 509 of the ink chamber 504. The top wall of the auxiliary ink chamber is provided with an opening, which is kept sealed with a cap 114C while refilling ink into the ink container, and is opened to fill the auxiliary chamber with ink. When refilling the auxiliary ink chamber with ink, the air entrance 502 must be covered with the cap 114C. Otherwise, ink will overflow. Further, the height of the auxiliary ink chamber must be regulated so that ink does not leak from the ink delivery member 517Y. As the ink in the ink chamber 504 is consumed to refill the ink container, the ink surface 509 slightly drops, becoming separated from the tip of the ink delivery tube from the auxiliary ink chamber. As a result, the tip of the ink delivery tube is exposed to the outside air, being allowed to take the outside air into the auxiliary ink chamber. As the outside air enters the auxiliary ink chamber, the ink within the auxiliary ink chamber flows into the ink chamber 504, raising the ink surface 509. Then, as the ink surface 509 rises and comes in contact with the tip of the ink delivery tube, the outside air is blocked from entering the auxiliary ink chamber through the ink delivery tube. Thus, the level of the ink surface 509 is rendered substantially stable. In other words, according to this embodiment, an ink level sensor is unnecessary (provision of a structure capable of preventing the ink level within the auxiliary ink chamber from dropping to zero level is desirable). As is evident from the description given above with reference to FIG. 6, according to this embodiment, it is possible to reliably provide the ink container with the ink head pressure difference necessary when ending the refilling of the ink container, and also, it is possible to stabilize the ink head pressure difference between the ink chamber 504 from which ink is delivered and the ink container 21 to which ink is delivered. In other words, it is possible to reliably fill the ink container 21 with ink by an amount proportional to the negative pressure generated in the ink container 21 through ink consumption.

As described above, the present invention makes it possible to easily and quickly refill the ink container simply by mounting the ink container in the ink refilling apparatus, without the need for a dangerous device such as a hypodermic needle, without causing ink leakage, and without tying up the user for a long time.

There are other ink refilling structures, beside the above described structures, in which the ink container must be moved from a recording apparatus to a dedicated ink refilling apparatus:

(1) Structure disclosed in U.S. Pat. No. 4,967,207, in which an ink jet unit is provided with a dedicated ink refilling port or a dedicated suction port for reducing the internal pressure of the tube and the ink container, and ink is refilled into the ink container at the service station in a recording apparatus;

(2) Structure disclosed in U.S. Pat. Nos. 5,367,328 and 5,369,429, in which an ink jet unit, and an ink refilling system for refilling ink into the ink container within the ink jet unit, are connected by a pipe, and ink is pumped into the ink container, while regulating the ink flow rate, after the amount of the ink in the ink container is detected by a sensor.

Hereinafter, the cases in which each of the above ink refilling structures is disposed in a recording apparatus will be described with reference to the drawings.

Figure 7A:
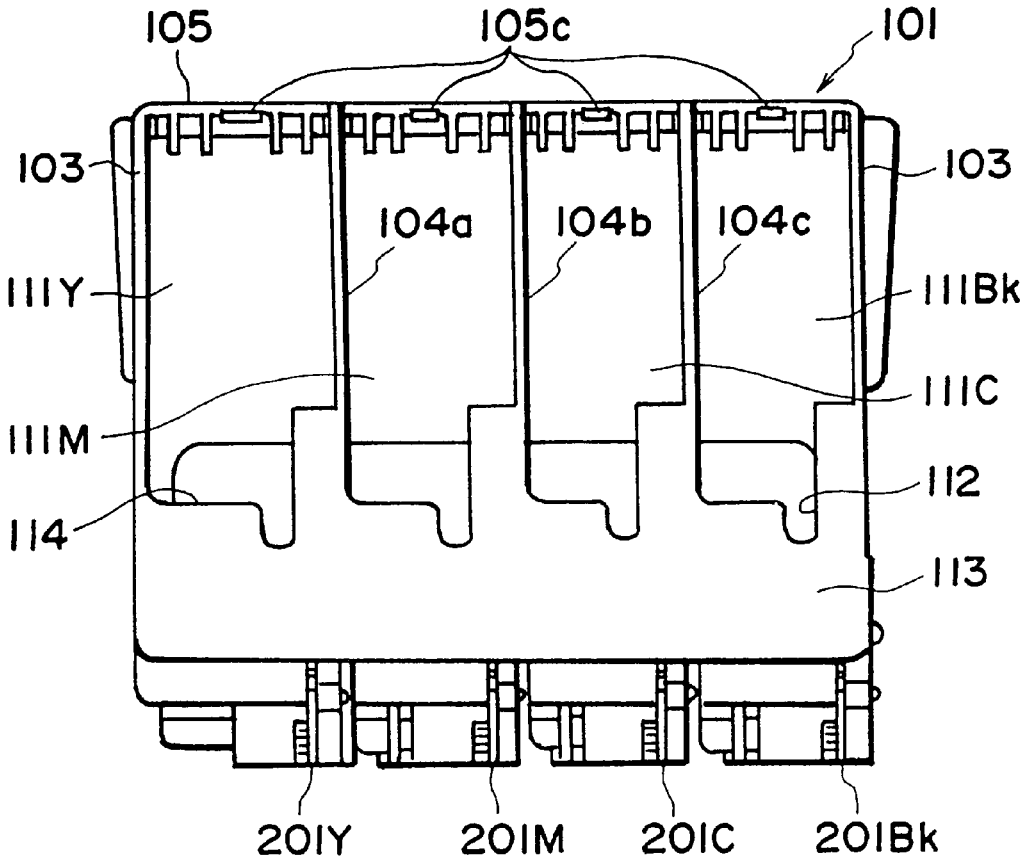
FIG. 7(*a*) is a front view of the ink jet unit to be mounted in the ink jet recording apparatus, in an embodiment of the present invention, and FIG. 7(*b*) is a bottom view thereof.
Figure 7B:
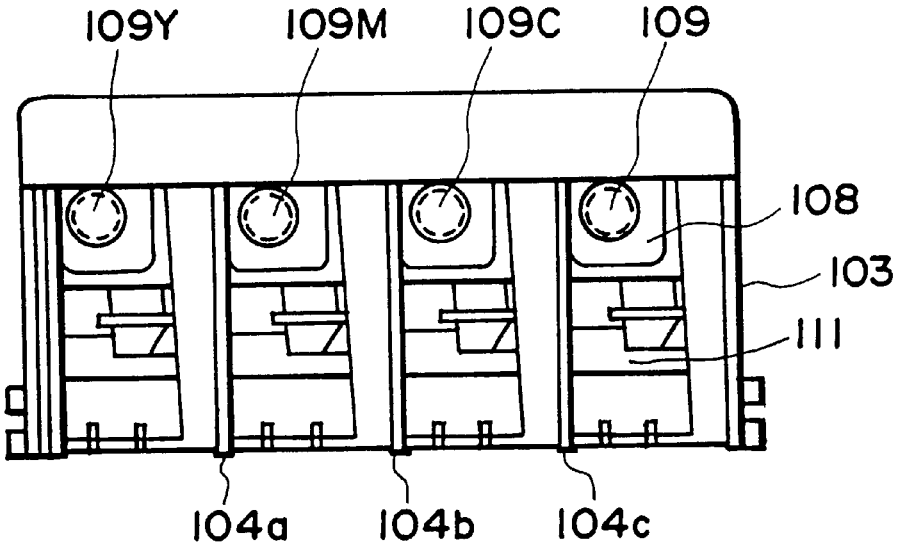

FIG. 7(*a*) is a front view of an example of the embodiment of the ink jet unit mountable in the ink jet recording apparatus in accordance with the present invention, and FIG. (b) is bottom view thereof.

Referring to FIG. 7, in this embodiment, the ink refilling structure comprises a shell 103, a front plate 113, middle plates 104*a*, 104*b* and 104*c*, nozzles 201Y, 201M, 201C and 201Bk, a dislodgment prevention portions 105*c*, an overhang 105, filters 109Y, 109M, 109C and 109Bk, elastic plates 108, and recording head portions 200Y, 200M, 200C and 200Bk. The shell 103 is constituted of a pair of lateral wall plates (unillustrated), and a back wall plate (unillustrated) which connects the pair of lateral wall plates. The front plate 113 is provided with notches 112, and is attached to the shell 103 in a manner to oppose the back wall plate, forming the holding space for the ink container. The middle walls 104*a*, 104*b* and 104*c* divide the space surrounded by the shell 103 and the front plate 113 into four ink container holding sub-spaces 111Y, 111M, 111C and 111Bk. The nozzles 201Y, 201M, 201C and 201Bk constitute outlets through which inks flow out of the corresponding ink containers (unillustrated) mounted in the ink container holding sub-spaces 111Y, 111M, 111C and 111Bk. The dislodgement prevention portions 105*c* and the overhang 105 are provided to prevent the ink containers from being dislodged from the corresponding ink container holding sub-spaces. Each of the filters 109Y, 109M, 109C and 109Bk is provided with its own elastic plate 108. The recording head portions creates images using the ink from the corresponding ink containers. The height of the font plate 113 is approximately ⅓ the height of the shell 103, and the ink containers are mounted or dismounted from the openings on the side of the front plate 113.

Figure 8:
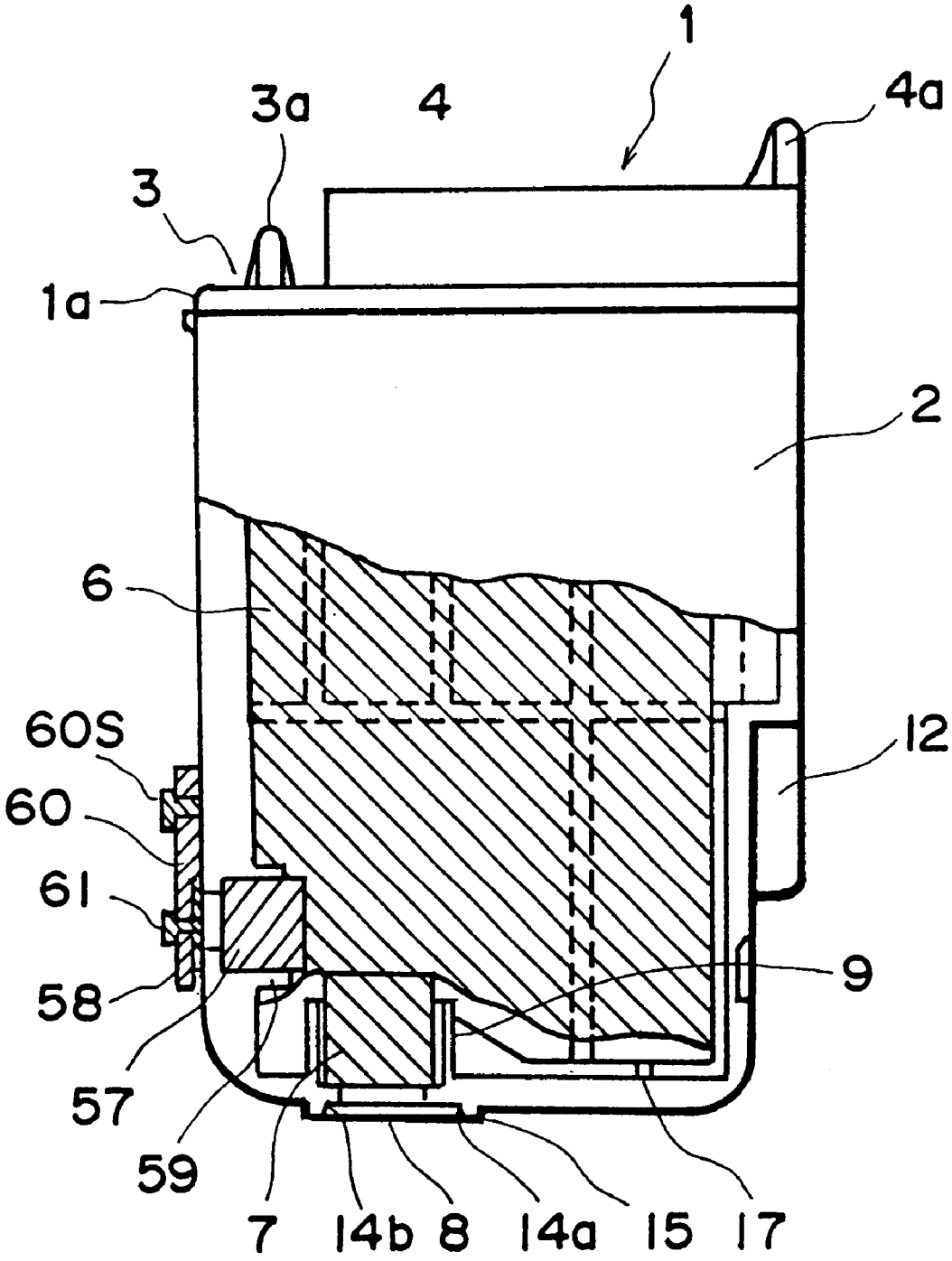
FIG. 8 is a schematic side view of a partially cutaway ink container in which ink is present.

FIG. 8 is a side view of the ink container which currently contains ink, and depicts the structure thereof.

This embodiment of the ink container illustrated in FIG. 8 is similar in basic structure to the preceding embodiments; therefore, only different portions will be described.

The structure of this embodiment comprises an ink refilling port 58, an ink reception member 57 in addition to the members and portions common to the preceding embodiments. The ink refilling port 58 is connected to an external ink refilling mechanism (unillustrated) for filling ink into the ink container 1. The ink reception member 57 is formed of the same material as the aforementioned ink delivery member 7 constituted of bundled strands of fiber, being substantially equal in length to the ink delivery member 7, and is disposed between the ink absorbent member 6 and the ink refilling port 58.

The ink delivery member 7 of the ink container 1, which is located in the portion to be joined with the recording head portion, is required to have an effective diameter determined in consideration of the pressure loss caused by the filter with which the ink delivery member 7 is placed in contact. On the other hand, the ink reception member 57 of the ink container, which is located in the portion to be joined with the ink refilling mechanism, is not provided with a filter, and therefore, pressure loss (flow resistance) in the joint between the ink reception member 57 and the ink refilling mechanism is not so much as the pressure loss in the joint between the ink container 1 and the recording head portion. Therefore, the external diameter of the ink reception member 57 can be reduced relative to that of the ink delivery member 7. Further, the ink container 1 comprises a support portion 59, which is inwardly erected from the peripheral edge of the ink refilling port 58 to support the ink reception member 57 within the ink container.

Further, the ink reception port 8 is provided with a cap 60 in order to prevent ink from evaporating through the ink reception port 8. The cap 60 is provided with an elastic seal member 61, and can be opened or closed by rotating it about a supporting shaft 60.

The ink reception member 57 guides ink only in one direction, that is, in the direction from the ink refilling port 8 toward the ink absorbent member 6 in this embodiment. As the ink reception member 57 is disposed adjacent to the ink delivery member 7, the ink reception member 57, the ink absorbent member 6, and the ink delivery member 7, are always in connection with each other in terms of ink path.

In this embodiment, when the ink reception member 57, and the ink delivery member of the ink refilling mechanism, are separated, the ink reception member 57 is always supplied with ink, and therefore, a meniscus is formed at the exposed surface of the ink reception member 57, preventing air from being sucked in.

FIG. 5 is a graph showing the relationship between the amount of ink consumption and the negative static pressure.

In FIG. 5, a point B is where ink stops flowing. The value of the point B changes in response to changes in the state of contact between the ink retaining member 6 and the ink delivery member 7, and the state of contact between the filter 109 (FIG. 7) and the ink retaining member 6. This is because the changes in these states of contact affect efficiency with which air is taken in. Generally, the value of the point B on vertical scale is approximately 100–150 mmAq in the case of an ink container employing foamed polyurethane.

As the ink refilling mechanism is connected to the ink delivery member 7 to unit the ink within the ink refilling mechanism and the ink remaining in the ink container through the ink reception member 57, the ink within the ink refilling mechanism is suck up into the ink container 1 by the negative static pressure $P_B$ (FIG. 5) generated by the ink absorbent member 6 and ink reception member 57. The negative static pressure at the end of the ink container 1 changes in the direction H which is opposite to the direction I in which the negative static pressure changes when the ink within the ink container 1 is consumed. The foregoing description is given with reference to the point at which ink stop flowing. However, this description is not limited to the point at which ink stop flowing; it is obvious that the description applies to any point between the point at which the ink container 1 is full and the point at which ink stop flowing.

Therefore, even when the ink container 1 is divided into sub-containers for various color inks, and each sub-container is different from the others in the amount of the ink storable in the ink absorbent member 6 and ink reception member 57, the size and configuration of the ink retaining member, or the amount of ink consumption therefrom, the ink refilling mechanism in accordance with the present invention can render the amount of the ink in each sub-container after refilling equal to as that before the ink container 1 is used first time.

In the case of the apparatus described above, even when three color inks are consumed at different rates, each color ink can be filled to a level at which the prerequisite negative static pressure $P_E$ is reached, as long as an initial arrangement is made so that the ink head pressure is equalized across all ink refilling mechanisms, that is, an equation: PY (head pressure of yellow ink)=PM (head pressure of magenta ink)=PC (head pressure of cyan ink) is satisfied.

In other words, when the user depletes one of the color inks, substantially the same amount of the color ink as the amount of the color ink which is in the container when the ink container 1 is purchased can be filled without excessively filling the other inks. As a result, the amounts of all color inks held in the ink container 1 become equal when refilling is completed. In reality, however, printing sometimes begins before ink refilling is completed, and in such occasions, the amounts of the different inks held in the ink container 1 do not become equal, but it does not occur that any of the inks overflows due to overfilling. Only difference is that the amounts of the inks might be less than the initial amount of the inks, and as far as printing is concerned, there will be no problem.

Figure 9:
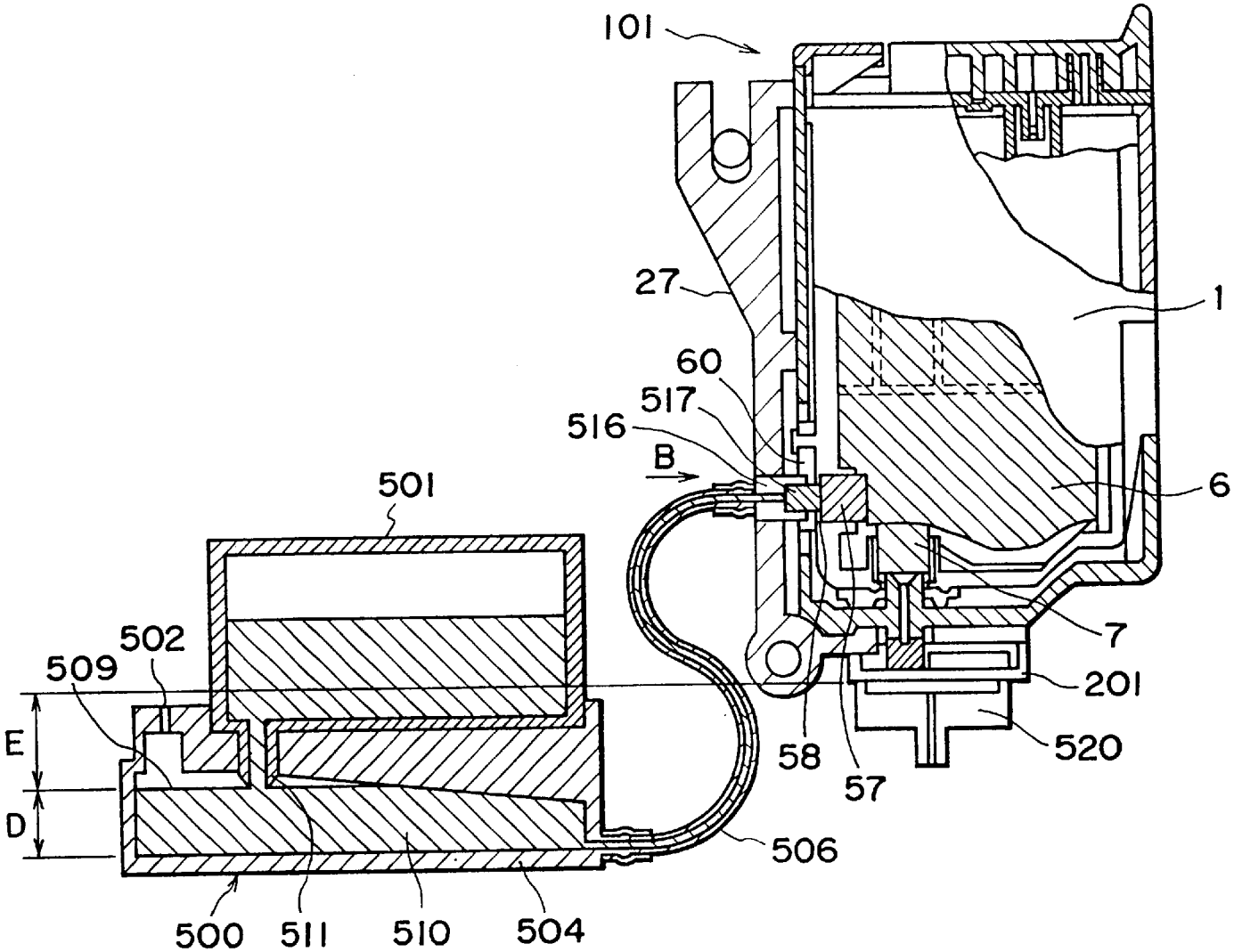
FIG. 9 is a sectional view of a part of a recording apparatus comprising the embodiment of an ink refilling mechanism in accordance with the present invention.

FIG. 9 is a section of another embodiment of a recording apparatus comprising the ink refilling mechanism in accordance with the present invention.

As is evident from FIG. 9, this embodiment comprises an ink jet unit 101, and a refilling system 500 which supplies ink to the ink jet unit 101. The refilling system 500 comprises an ink chamber 504 for storing ink, an ink delivery tube 506 for delivering the ink 510 within the ink chamber 504 to the ink jet unit 101, and an air entrance 502 for introducing the outside air into the ink chamber 504. The tip of the ink delivery tube 506 is provided with an ink delivery portion 516 with an ink delivery member 517. The ink delivery member 517 is formed of porous material and is pressed into the ink delivery portion 516. Since simply pressing the ink delivery member 517 into the ink delivery portion 516 is liable to allow the ink delivery member 517 to fall out during transportation, using adhesive in addition to pressing is more desirable. In order to keep the ink level in the ink chamber 504 substantially stable, a refill ink container 501 which contains the ink to be delivered to the ink chamber 504 is given a chicken feed type structure.

Hereinafter, the ink filling operation of the recording apparatus structured as described above will be described.

First, the delivery tube 511 of the refill ink container 501 is inserted into the ink chamber 504.

Then, air enters the refill ink container 501 through the ink delivery tube 511 of the refill ink container 501, allowing the ink within the refill ink container 501 to enter the ink chamber 504.

As the tip of the ink delivery tube 511 of the chicken feeder type auxiliary ink container 501 comes in contact with the ink surface 509, the level of the ink surface 509 stabilizes. At that moment, the ink delivery member 517 is not wet with ink. Therefore, ink can be delivered from the ink delivery portion 516 into the ink container 2 by lowering the ink delivery portion 516 below the ink surface 509.

As described previously, the ink delivery member 517 is constituted of bundled stands of fiber or the like, and therefore, when it is wetted with ink, a meniscus (unillustrated) is formed thereon, preventing ink from dripping. The ink delivery member 517 sucks up and retains ink by capillary force as the ink delivery member 27 of the ink container does. Therefore, even after the ink delivery portion 516 is returned to the original level at which the ink delivery portion 516 is higher than the ink surface 509, the ink delivery member 517 and the path therefrom to the ink chamber 504 remain filled with ink.

The air entrance 502 is sealed with a seal member, a porous water repellent film, or the like (unillustrated), which is pasted thereto, to prevent ink from leaking during transportation.

Figure 10:
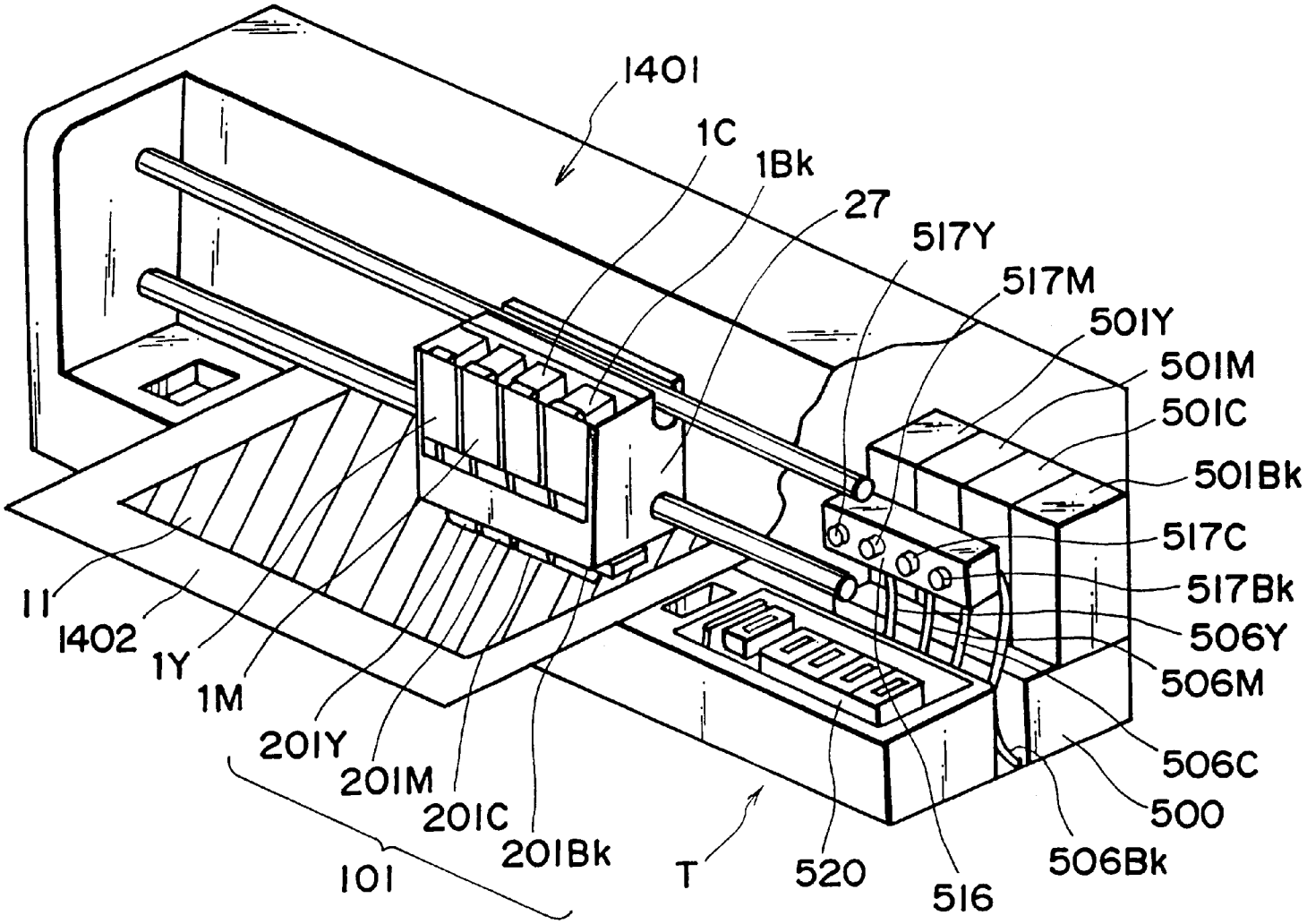
FIG. 10 is an external perspective view of the recording apparatus illustrated in FIG. 9.
Figure 11:
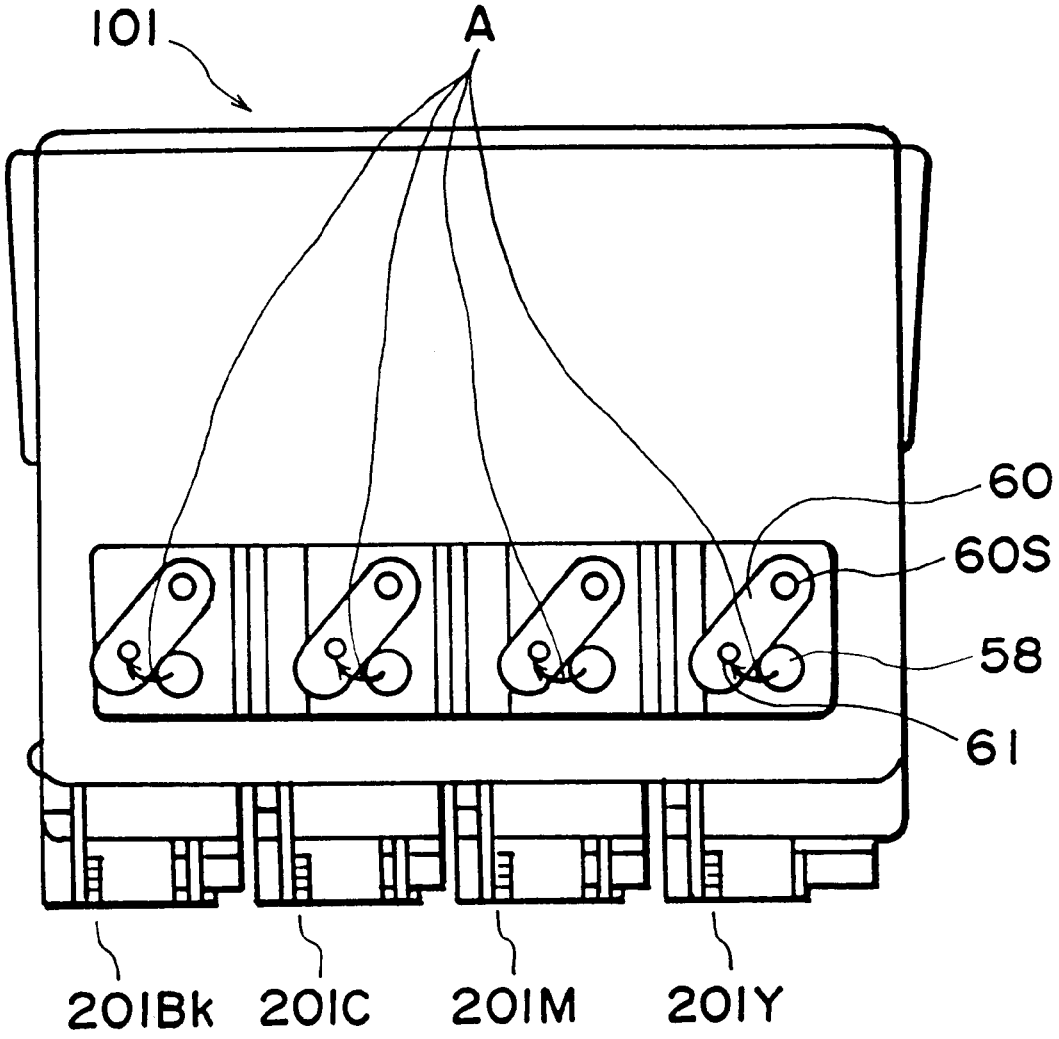
FIG. 11 is a rear view of the ink container illustrated in FIG. 8, wherein the caps are off.

FIG. 10 is an external perspective view of the recording apparatus illustrated in FIG. 9. FIG. 11 is a rear view of the ink container 1 illustrated in FIG. 8, in which the cap 60 is off.

Referring to FIG. 10, when the recording head portion (unillustrated) comprising nozzles 201Bk, 201C, 201M and 201Y is at a position T to which it is retracted when not printing (hereinafter, home base position T) in the recording apparatus, it is covered with a cap 520 to prevent ink from evaporating from the recording head, or to prevent thickened or solidified ink from adhering to the recording head.

When the recording head is in the same state as described in the foregoing, the cap 60 of the ink reception port 58 of the ink container 1, which is mounted on a shaft 60s and can be opened or closed by a cap lever (unillustrated) in the direction indicated by an arrow mark A in FIG. 11, is open. The ink delivery member 517 disposed at the tip of the ink delivery portion 516, which is insertable in the in reception port 58 by moving the ink delivery portion 516 in the direction of an arrow mark B in FIG. 9, is in the ink reception port 58, and the ink reception member 57 and the refilling system 500 is in connection with each other.

In this embodiment, as the ink delivery member 517 and the ink reception member 57 are connected (in reality, they are pressed against each other), the ink meniscuses present at the exposed tips of their bundled strands of fiber are destroyed. As a result, the ink 510 within the refilling system 500 and the remaining ink (unillustrated) of the ink container 1 are united, and the ink within the refilling system 500 is sucked up into the ink container 1 by the negative static pressure $P_B$ (FIG. 5) generated by the ink retaining member 6 and the ink delivery member 7. While ink is sucked into the ink container 1, the negative static pressure at the end surface of the ink container 1 changes in the H direction which is opposite to the I direction in which it changes while ink is consumed from the ink container 1.

As the ink within the refilling system 500 is delivered into the ink container 1, the ink within the refill ink container 501 mounted on the refilling system 500 is delivered into the ink chamber 504 of the refilling system 500. However, since the refill ink container 501 mountable on the refilling system 500 in this embodiment is of the chicken feeder type, the ink delivery from the refill ink container 501 into the ink chamber 504 stops as soon as the ink surface 509 reaches the ink delivery tube 511. This is because the outside air is prevented from entering the ink delivery tube 511 when the ink surface 509 is in contact with the ink delivery tube 511. As the ink 510 within the ink chamber 504 is consumed to refill the ink container 1, and as a result, the level of the ink surface 509 slightly drops, the ink surface becomes separated from the tip of the ink delivery tube 511, exposing the tip to the outside air. Consequently, the outside air is taken into the ink container 1, releasing, in return, the ink within the refill ink container into the ink chamber 504 to raise the ink surface 509. As the raised ink surface 509 reaches the tip of the ink delivery tube 511, the ink delivery into the ink chamber 504 stops again. Therefore, the level of the ink surface 509 remains substantially stable.

Thus, this embodiment assures that the ink head pressure at the external end of the ink delivery member 7 becomes substantially equal to the prerequisite ink head pressure at the end of ink refilling. In addition, while ink is delivered from the ink chamber 504 into the ink container 1, the head pressure of the ink can be kept stable; ink refilling condition can be kept stable. In other words, this embodiment assures that the ink container 1 is refilled with ink by the amount proportional to the negative pressure generated by the ink consumption from the ink container 1. Further, the refill ink container 501 may be provided with a sensor (unillustrated) for detecting the amount of the remaining ink, so that it becomes possible to detect when the ink 510 within the refill ink container 501 is depleted. This is because the ink refilling condition can be further stabilized when the refill ink container 501 is replaced only after the ink 510 within the refill ink container 501 is depleted.

Again referring to FIG. 10, the main assembly of the refilling system 500 is disposed at the home base position T of the recording head. One ends of the ink delivery tubes 506Y, 506M, 506C and 506Bk are connected to the main assembly of the refilling system 500, and the other ends are connected to the ink delivery portion 516 which is provided with the ink delivery members 517Y, 517M, 517C and 517Bk.

In this embodiment, the density of the ink reception member 57 of the ink refilling system, and the density of the ink delivery member 7 of the ink container 1, are rendered substantially the same, and are set at a level equal to, or larger than, the density of the ink absorbent member 6 disposed between the two, so that ink is always absorbed from the ink absorbent member 6 into the ink reception member 57 and the ink delivery member 7, and remain therein, to maintain the ink path established between the two member. Further, they are set at a level higher (for example, −500 mmAq) than the capillary force (generally, −30 mmAq−−100 mmAq) of the ink absorbent member 6 in the ink container 1 so that ink flow interruption, ink leakage, and the like, can be prevented. On the other hand, the density of the ink delivery member 517 has only to be high enough to create sufficient capillary force (−50 mmAq or so) to prevent the ink flow in the refilling apparatus from being interrupted. Therefore, the density of the ink delivery member 517 can be reduced, allowing the external diameter thereof to be reduced without increasing the flow resistance. As a result, refilling time can be reduced. Further, in case both ink delivery member 517 and the ink reception member 57 are the same in density and material, the following occurs. That is, when the strands of fiber in both members perfectly meet the counterparts, the cross-section of the ink path provided by the bundled strands of fiber becomes largest, but when they completely miss the counterparts, the cross-section of the ink path becomes minimum, that is, almost zero. In other words, rendering them different in density is not rendering the cross-section of the ink path smaller, and can reduce the refilling time. This statement applies to the case in which both ink delivery members are the same in structure as described above. However, when both ink delivery members are different in structure, for example, when one is in the form of felt, and the other is in the form of parallelly bundled strands of fiber, the refilling system works more effectively.

Further, the ink delivery member 7 of the ink container 1, which is located in the portion to be joined with the recording head portion, has an effective diameter determined in consideration of the pressure loss caused by the filter with which the ink delivery member 7 is placed in contact. On the other hand, since the ink reception port 58 to which the ink delivery member 517 of the ink refilling member is connected, is not provided with a filter, pressure loss (flow resistance) is not so much as the pressure loss in the joint between the ink container 1 and the recording head portion. Therefore, the external diameter of the ink reception member 57 can be reduced to prevent ink from evaporating, or to prevent solidified ink from adhering to the adjacencies.

Through the aforementioned series of states, he ink 510 within the ink chamber 504 is flawlessly sucked up into the ink container 1 by the negative static pressure of the ink retaining member 6. Eventually, the refilling stops due to the characteristic of the negative static pressure of the ink retaining member 6 as the distance between the ink surface 509 and the bottom of the each nozzle 201Bk, 201C, 201M, or 201Y increases to a distance of E, for example, 20 mm. The value of the distance E is dependent upon the specifications of the ink container 1 such as the prerequisite negative static pressure.

According to this embodiment, ink can be refilled while an actual recording operation is not going on. Therefore, the refilling does not tie up the user. Further, since the refilling of the ink container 1 is effected by the static negative pressure generated in the ink container 1 itself through the ink consumption therefrom, ink leakage or overflow which is caused by the overfilling of ink does not occurs; a proper amount of ink is always retained in the ink container 1. Also, if print quality becomes poor due to the deterioration of polyurethane, a widely used ink absorbent material, the ink container can be easily replaced. Therefore, it is unnecessary to stop the apparatus, and the user is not tied up for a long time.

Also in this embodiment, in order to improve reliability, the joint portion of the ink container 1 is provided with the ink delivery member 7. The ink delivery member 7 prevents ink leakage when the ink container is mounted or removed. Also, it prevents air from entering the joint and blocking ink delivery. However, the provision of the ink delivery member 7 is not prerequisite. For example, an ink container can be rendered replaceable by increasing the compression ratio (density) of the ink absorbent member 6, in the joint portion of the ink container, which is connected to the ink recording head.

Figure 12:
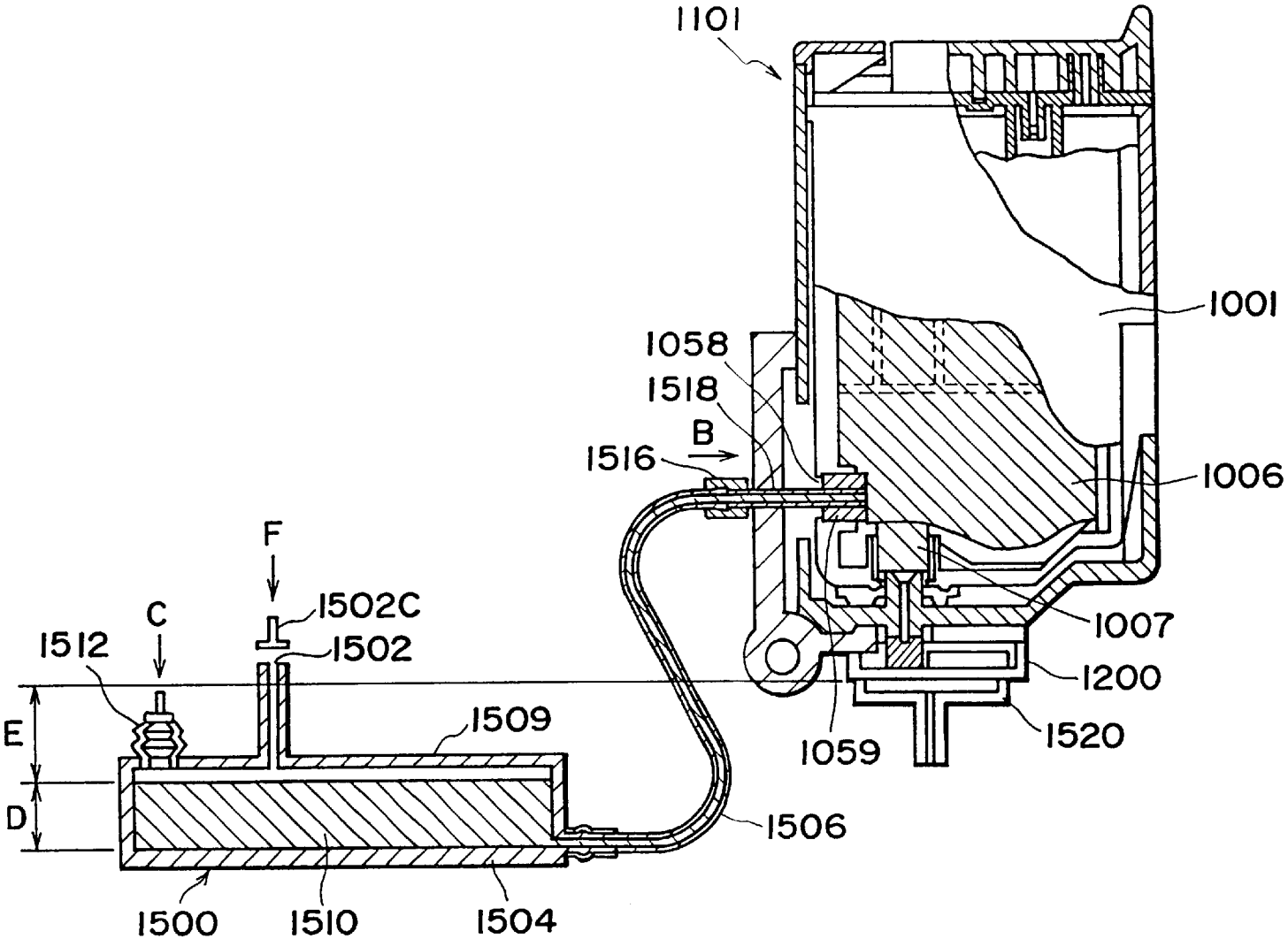
FIG. 12 is a sectional view of a part of a recording apparatus comprising another embodiment of the ink refilling mechanism in accordance with the present invention.

FIG. 12 is a section of a part of another embodiment of a recording apparatus comprising the ink refilling mechanism in accordance with the present invention.

The recording apparatus in FIG. 12 comprises an ink jet unit 1101, and a refilling system 1500 which supplies ink to the ink jet unit 1101. The refilling system 1500 comprises an ink chamber 1504 for storing ink, an ink delivery tube 1506 for delivering the ink 1510 within the ink chamber 1504 to the ink jet unit 1101, and an air entrance 1502 for introducing the outside air into the ink container 1504. The tip of the ink delivery tube 1506 is provided with an ink delivery portion 1516 having an ink delivery needle 1518.

When the recording apparatus is in the state illustrated in FIG. 12, a carriage 1027 carrying the ink jet unit 1101 comprising the ink container 1001 is at the home base position T (FIG. 10) in the recording apparatus, and in this state, the ink delivery needle 1518 with a sharp tip, which is disposed at the tip of the ink delivery portion 1516, is inserted into the rubber plug 1059 with a hole, that is, an elastic member, removably plugging the ink filling port 1058 of the ink container 1001, by moving the ink delivery portion 1516 in the direction of the arrow mark B. As a result, the ink absorbent member 1006 and the refilling mechanism 1500 is connected.

Hereinafter, the ink filling operation of the recording apparatus structured as described in the foregoing will be described.

When the ink delivery needle 1518 is not in the rubber plug 1059, the level of the ink surface in the ink delivery tube 1506 is the same as the level of the ink 1509 within the in chamber 1504.

First, the ink delivery needle 1518 is inserted into the rubber plug 1059, and a rubber plug 1502C is moved in the direction of an arrow mark F by a depressing mechanism (unillustrated) comprising a solenoid, a linkage, and the like, to plug an air entrance 1502.

Next, a pressurizing mechanism 1512 is pressed by a pressing mechanism (unillustrated) comprising a solenoid, a linkage, and the like, whereby the ink 1510 within the ink chamber 1504 is sent to the ink delivery needle 1518, uniting the ink 1510 within the refilling mechanism 1500 and the remaining ink (unillustrated) of the ink container 1001. As a result, the ink 1510 within the refilling mechanism 1500 is sucked up into the ink container 1001 by the negative static pressure $P_B$ (FIG. 5) generated by the ink retaining member 1006 and the ink delivery member 1007.

The amount of the ink sent by the pressurizing mechanism 1512 has only to be equal to the combined internal volume of the ink delivery tube 1506 and the ink delivery needle 1518.

According to this embodiment, it is unnecessary to provide the ink container with the cap for the ink filling opening, and the mechanism for opening or closing the cap. Further, using chlorinated rubber as the material for the rubber plug can eliminate the worries concerning ink evaporation or ink solidification. Therefore, an ink refilling system can be inexpensively produced.

In this embodiment, the rubber plug 1059 is disposed in a manner to compress the ink absorbent member 1006 as the ink delivery member 1007 does, being always in contact with ink, but this arrangement is not prerequisite. Even if the rubber plug 1059 does not compress the ink absorbent member 1006, that is, even if two are apart from each other, as long as the tip of the ink delivery needle 1518 is inserted deep enough to reach the compressed portion of the ink absorbent member 1006, that is, the portion near the ink delivery member 1007, there will be no problem. However, in the latter case, it is necessary to increase the insertion stroke.

Also, according to the mechanical arrangement of this embodiment, when the recording head portion is retracted to the home base position, the ink refilling mechanism is always connected with the ink container. However, the present invention is not limited to this arrangement. For example, the ink refilling mechanism may be connected to the ink container a predetermined length of time after the recording head portion is retracted to the home base position, or when the power source is turned off, in consideration of the durability of the connecting mechanism, the time lag to the beginning of the refilling operation, and the like.

Since the present invention is structured as described above, it has the following effects.

According to the present invention, an ink reception member formed of porous material is disposed in an ink container, being pressed against an ink absorbent member disposed also in the ink container, and a first ink delivery member formed of porous material is disposed within a refilling mechanism, wherein the ink container and the refilling mechanism are connected in a manner to cause the ink reception member and the first ink delivery member to press against each other, in order to deliver the ink stored in the refilling mechanism into the ink container. Therefore, the ink container can be reliably refilled with ink without aggressively reducing the internal pressure of the ink container by a pump or the like.

As a result, deterioration of print quality can be prevented, and also, the external ink leakage which occurs during the refilling of the ink container can be prevented.

A second ink delivery member formed of porous material is disposed in the ink container, being pressed against the ink absorbent member, wherein the ink within the ink container is delivered to a recording head portion through the second ink delivery member. Therefore, the ink within the ink container can be reliably delivered to the recording head without causing ink leakage.

The external diameter of the ink reception member is rendered smaller than the external diameter of the second ink delivery member. Therefore, the ink container size can be reduced.

The density of the ink reception member is rendered higher than the density of the ink absorbent member. Therefore, the external ink leakage from the ink container can be prevented.

The density of the ink reception member and the second ink delivery member are rendered higher than the density of the ink absorbent member. Therefore, the same effect as the effect described in the foregoing paragraph can be obtained, that is, the external ink leakage from the ink container can be prevented.

The density of the first ink delivery member is rendered lower than the density of the ink reception member. Therefore, the ink within the refilling mechanism can be reliably delivered into the ink container.

The ink reception port of the ink container is provided with a covering member. Therefore, the ink within the ink container can be prevented from evaporating or solidifying.

Further, the ink container is rendered removably connectable to the recording head. Therefore, the ink container can be easily exchanged with a fresh one as ink container performance deteriorates.

While the invention has been described with reference to the structures disclosed herein, it is not confined to the details set forth, and this application is intended to cover such modifications or changes as may come within the purposes of the improvements or the scope of the following claims.

What is claimed is:

1. An ink jet recording apparatus comprising:

an ink container for accommodating ink in a porous ink absorbing material therein;

a recording head for effecting recording using ink supplied from the ink container;

a refilling mechanism for refilling the ink to said ink absorbing material; and an ink introducing member comprised of a bundle of fibers, said ink introducing member being provided in the ink container for introducing the ink into said ink absorbing material from said refilling mechanism;

wherein said refilling mechanism includes an ink chamber for containing the ink to be supplied into said ink absorbing material, and a first ink discharge member of porous material for supplying into said ink absorbing material the ink accommodated in said ink chamber by being press-contacted to said ink introducing member;

wherein said first ink discharge member has a density smaller than that of said ink introducing member.

2. An apparatus according to claim 1, wherein said ink introducing member has a density which is larger than that of the ink absorbing material.

3. An apparatus according to claim 1, wherein the ink container is provided with a second ink discharge member of porous material, press-contacted to said ink absorbing material, for supplying to the recording head the ink contained in the ink absorbing material.

4. An apparatus according to claim 3, wherein said ink introducing member has an outer diameter smaller than that of the second ink discharge member, and wherein said ink introducing member and said second ink discharge member are formed of the same material and are substantially equal in length.

5. An apparatus according to claim 3, wherein said ink introducing member and said second ink discharge member have densities which are larger than that of said ink absorbing material.

6. An ink container for containing ink to be supplied to a recording head, comprising:

a main body;

ink absorbing material accommodated in the main body to contain the ink in the main body;

a connecting portion relative to a supply tube of the recording head for supplying the ink to the recording head;

an ink delivery member comprised of porous material at said connecting portion in contact with said ink absorbing material, said ink delivery member positioned to receive the supply tube of the recording head;

a refilling connecting portion, at a position different from that of said connecting portion, for refilling the ink to said ink absorbing material; and an ink introducing member at said refilling connecting portion, said ink introducing member comprised of a bundle of fibers in contact with said ink absorbing material;

wherein said ink introducing member has a capillary force higher than that of said ink absorbing material; and wherein said ink introducing member has a diameter smaller than that of said ink delivery member, and said ink introducing member and said ink delivery member are formed of the same material and are substantially equal in length.

* * * * *

UNITED STATES PATENT AND TRADEMARK OFFICE

CERTIFICATE OF CORRECTION

PATENT NO. : 6,338,552 B1
DATED : January 15, 2002
INVENTOR(S) : Osamu Sato et al.

It is certified that error appears in the above-identified patent and that said Letters Patent is hereby corrected as shown below:

Column 1,
Line 63, "has" should read -- have --.

Column 2,
Line 4, "only" should read -- the only --; and
Line 6, "begin" should read -- begins --.

Column 3,
Line 27, "-refilling" should read -- refilling --.

Column 5,
Line 23, "pores" should read -- pore --;
Line 37, "recording-head" should read -- recording head --; and
Line 64, "prevents" should -- prevent --.

Column 6,
Line 7, "stands" should read -- strands --; and
Line 49, "provided" should read -- provide --.

Column 8,
Line 19, "such" should read -- such as --;
Line 42, "is" should read -- are --; and
Line 46, "is" should read -- are --.

Column 9,
Line 24, "of a" should read -- of --;
Line 40, "sub-container" should read -- sub-containers --; and
Line 60, "member" should read -- members --.

Column 10,
Line 60, "has" should read -- has to --; and
Line 66, "illustrate" should read -- illustrates --.

UNITED STATES PATENT AND TRADEMARK OFFICE

CERTIFICATE OF CORRECTION

PATENT NO. : 6,338,552 B1
DATED : January 15, 2002
INVENTOR(S) : Osamu Sato et al.

It is certified that error appears in the above-identified patent and that said Letters Patent is hereby corrected as shown below:

Column 12,
Line 10, "font" should read -- front --;
Line 38, "snappily" should read -- snapingly --; and
Line 47, "snappily" should read -- snapingly --.

Column 14,
Line 19, "thee" should read -- three --.

Column 15,
Line 42, "a dislodgment" should read -- dislodgment --; and
Line 63, "creates" should read -- create --.

Column 16,
Line 39, "shaft 60." should read -- shaft 60S. --; and
Line 65, "unit" should read -- unite --.

Column 17,
Line 1, "suck" should read -- sucked --;
Lines 8, 9 and 11, "stop" should read -- stops --;
Line 21, "as" should be deleted;
Line 22, "first" should read -- the first --; and
Line 41, "Only" should read -- The only --.

Column 18,
Line 46, "the in" should read -- the ink --; and
Line 50, "is in" should read -- are in --.

Column 19,
Line 54, "member." should read -- members. --.

Column 20,
Line 27, "he" should read -- the --;
Line 33, "the" (second occurrence) should be deleted; and
Line 44, "occurs;" should read -- occur; --.

UNITED STATES PATENT AND TRADEMARK OFFICE

CERTIFICATE OF CORRECTION

PATENT NO. : 6,338,552 B1
DATED : January 15, 2002
INVENTOR(S) : Osamu Sato et al.

It is certified that error appears in the above-identified patent and that said Letters Patent is hereby corrected as shown below:

Column 21,
Line 18, "is connected." should read -- are connected. --; and
Line 25, "in" should read -- ink --.

Column 24,
Line 5, "ink" should read -- an ink --.

Signed and Sealed this

Second Day of July, 2002

*Attest:*

*Attesting Officer*

JAMES E. ROGAN
*Director of the United States Patent and Trademark Office*